US006178339B1

(12) United States Patent
Sakai et al.

(10) Patent No.: US 6,178,339 B1
(45) **Date of Patent: *Jan. 23, 2001**

(54) WIRELESS COMMUNICATION FILTER OPERATING AT LOW TEMPERATURE

(75) Inventors: Masahiro Sakai, Osaka; Hidetaka Higashino, Kyoto; Kentaro Setsune, Osaka, all of (JP)

(73) Assignee: Matsushita Electric Industrial Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/629,349

(22) Filed: Apr. 8, 1996

(30) Foreign Application Priority Data

| | | |
|---|---|---|
| Apr. 11, 1995 | (JP) | 7-085707 |
| Apr. 18, 1995 | (JP) | 7-092584 |
| May 26, 1995 | (JP) | 7-127712 |
| Jun. 2, 1995 | (JP) | 7-136525 |
| Jun. 2, 1995 | (JP) | 7-136526 |

(51) Int. Cl.[7] ..... H01P 1/213; H01B 12/02

(52) U.S. Cl. ..... 505/210; 505/700; 505/701; 505/866; 333/99.005; 333/126; 333/134; 333/202; 333/204; 333/260

(58) Field of Search ..... 333/995, 202, 333/204, 205, 260, 126, 129, 134, 136; 505/210, 202, 700, 701, 706, 866

(56) References Cited

U.S. PATENT DOCUMENTS

| | | | | |
|---|---|---|---|---|
| 3,857,114 | * | 12/1974 | Minet et al. | 505/866 X |
| 4,487,999 | * | 12/1984 | Baird et al. | 333/260 X |
| 4,528,530 | * | 7/1985 | Ketchen | 505/866 X |
| 5,179,074 | * | 1/1993 | Fiedziuszko et al. | 505/210 |
| 5,244,869 | * | 9/1993 | Billing | 505/202 |
| 5,489,880 | * | 2/1996 | Swarup | 333/204 X |

FOREIGN PATENT DOCUMENTS

| | | | | |
|---|---|---|---|---|
| 2-60203 | | 2/1990 | (JP) . | |
| 31502 | * | 2/1990 | (JP) | 333/127 |
| 5198433 | * | 8/1993 | (JP) | 505/866 |

OTHER PUBLICATIONS

R. Babbitt et al., "Fabrication and Evaluation of Superconducting Devices", *Microwave Journal*, vol. 34, No. 4, Apr. 1991, pp. 40 ff.

Raafat R. Mansour, "Design of Superconductive Multiplexers Using Single–Mode and Dual–Mode Filters", *IEEE Transactions on Microwave Theory and Techniques*, vol. 42, No. 7, pp. 1411–1418, Jul. 1994.

Communication from European Patent Office and attached Search Report, Jan. 1998.

* cited by examiner

*Primary Examiner*—Benny T. Lee
(74) *Attorney, Agent, or Firm*—Merchant & Gould P.C.

(57) ABSTRACT

A high power filter apparatus which is used in a mobile communication base station or the like is provided wherein the temperature stability and frequency selection are excellent, an insertion loss is small, the size is small, power consumption is low and costs are low. A shield case block comprises signal input and output portions, and a plurality of closed spaces which house a filter element connected between the signal input and output portions. A cooling plate is provide in a heat insulating container which houses the shield case block. The shield case block is fixed to the cooling plate in the thermal contact state. Each filter element is place almost in parallel. A cylindrical hole having an axis which is almost parallel with the face of the filter element penetrates the shield case block. A ground rod made of a conductor which changes the volume of the closed space is provided on the inner end portion of a movable member which moves in the axial direction of the cylindrical hole.

12 Claims, 13 Drawing Sheets

WIRELESS COMMUNICATION FILTER OPERATING AT LOW TEMPERATURE

FIELD OF THE INVENTION

The present invention relates to a high power integrated small-sized filter apparatus used in a transmitting portion of a base station in a mobile communication system for performing communication with a plurality of frequency communication channels which are adjacent to each other wherein an aggregated filter element is cooled for use, and more particularly to a low-temperature operating filter apparatus for high power transmission in which a superconductor is used for an electrode material.

BACKGROUND OF THE INVENTION

A dielectric resonator filter having a high Q value has been widely utilized as a high power filter for transmission for a base station in mobile communication at frequencies in an 800 MHz (Mega Hertz) to 1.5 GHz (Giga Hertz) band. A filter is necessary for each channel. An apparatus which houses sixteen filters for 16 channels as a group is usually used. Each filter is cooled by air or water for use because it has an insertion loss of about 40% when ten or more Watts are input.

A junction box type power filter apparatus which is used for the transmitting portion of the base station has a structure shown in FIG. 13 (see "THE BASIS OF MOBILE COMMUNICATIONS": The institute of electronics, information and communication engineers by Yoshihisa Okumura et. al. pages 255 to 256). In FIG. 13, 16-channel transmitters having varying frequencies within a frequency band are connected to resonator filters 542 through isolators 541. Each resonator filter 542 is formed by a dielectric resonator and is designed in such a manner that a signal within a band ranging from one to one hundred kilohertz (Khz) sent from the connected transmitter passes therethrough.

In consideration of space and installation costs, an antenna is usually shared in mobile communication. For this reason, a junction box is used. The junction box merges the outputs of a plurality of bandpass filters having different passband frequencies and close resonant frequencies to share an output transmission line. The junction box according to the prior art is connected to the output end of a microwave filter which uses a cavity resonator, a dielectric resonator or the like, and utilizes a coaxial line or the like.

In FIG. 13, a junction box 543 is used in order to connect 16-channel signals to a line while performing impedance matching. As shown in FIG. 13, branch lines formed by coaxial cables are hierarchically connected in the junction box 543. More specifically, the branch lines 544 having a length of $\lambda/4$ (i.e., approximately one quarter wavelength) are connected to the output sides of 16 resonator filters. Four branch lines 544 are collected into one and connected at four merging points. Branch lines 545 having a length of $\lambda/2$ are connected to the merging points. Two branch lines 545 are collected into one and connected at two merging points. Furthermore, branch lines 546 having a length of $\lambda/2$ are connected to the two merging points. The two branch lines 546 are connected to each other at a merging point to which the output line of a super power circulator. The super power circulator is connected to an antenna through a bandpass filter for preventing transmission of spurious signals outside the pass band.

The operating principle of the junction box is as follows. As seen from the merging point, the filters which resonate take impedance matching and other resonators are short-circuited. Accordingly, if outputs are merged at a distance of $(2n+1)\lambda/4$ from the output end of the filter, the impedance of the branch line in the non-resonant state becomes infinite at the merging point. If the output passes through the branch line which is at a distance of $(m+1)\lambda/2$ from the merging point, the impedance is not changed. Consequently, a mismatching loss is not caused even if the outputs of signals are merged again at the same position. As a result, transmission lines having a low loss can be shared. $\lambda$ is a wavelength at the average resonant frequency of the filter (electric length), and n and m are 0 or natural numbers.

The impedance of each resonator filter seen from the merging point of the coaxial cable having a length of $\lambda/4$ is equal to the characteristic impedance of an output line for the frequency of a passband, and is considerably increased for other frequencies. Consequently, the characteristics of other filters are hardly influenced. Consequently, the outputs of the resonators can be merged easily.

Referring to the filter apparatus according to the prior art, dielectric resonator filters for the number of channels are housed in a housing unit, and signals from the filters are merged to an output line by a junction box formed by coaxial cable branch lines. Consequently, the size of the apparatus is increased.

In a high power filter apparatus, a plurality of plane circuit type filters are formed by normal conductive metal electrodes which are not merged by the junction box and which have a coaxial line structure according to the prior art and which are operated at an ordinary temperature because of a low Q value and a high insertion loss. Even if such a filter apparatus can be put to practical use, each filter should be mounted on a shield case and connected to the junction box by a connector. Consequently, the size of the apparatus is increased and a connecting loss at each connector is caused.

While a plane circuit filter which forms a filter electrode with a superconductive thin film that has recently been developed is characterized by a high Q value, a low loss and a high output, it should be cooled to a low temperature to operate in the superconductive state. Conventionally, a superconductive filter unit housed in a shield case is fixed to a cryostat cold head to execute evaluation experiments on a laboratory level. For example, the shield case is connected to a semi-rigid cable by means of a general SMA type connector or the like and the other end side of the semi-rigid cable is connected to a connector provided on the wall of a heat insulating container so that the signal of the filter is input and output. However, an example in which a plurality of superconductive plane circuit filters are used to form the high power filter such as a mobile communication base station or the like has not been reported.

In a filter apparatus which houses a plurality of dielectric resonator filters, a power loss is great. For example, an insertion loss is 2 to 3 decibels (dB) at a frequency of about 1.5 GHz. Consequently, it is necessary to house the filter apparatus in a large-sized rack to be cooled by air or water. The dimension of each dielectric resonator is about 100 millimeter (mm) diameter ($\phi$)×120 mm height (H). The 16-channel filter portion has a width of 25 centimeter (cm), a depth of 25 cm and a height of 1 meter (m). If a space in which a cooling system for air or water cooling is included, the dimension of the whole filter apparatus is increased more. Furthermore, the power consumption for a predetermined transmitted power is so great that the filter apparatus is not economical.

When a resonant frequency is changed due to a change in temperature of the filter, there is a possibility that a mobile communication system will become hard to operate. Consequently, temperature stability is a necessary design constraint of the filter apparatus which generally increases the costs of the filter apparatus.

In addition, the channel frequency adjustment/tuning mechanisms should be provided at every filter which results in increased costs.

A semi-rigid cable, a coaxial cable for high power or the like is cut into pieces having a length of several cm are used for a branch line. Consequently, it is hard to manufacture a connecting portion. It is necessary for the skilled artisan in the art to manually perform processing, measurement and adjustment. For this reason, the junction box is disadvantageous to characteristic repeatability, manufacturing, costs and the like.

In the case where microwaves having a high power are incident on a superconductive filter according to the prior art and are merged by the junction box using a metal in the vicinity of a normal temperature, the temperature of a superconductive filter element becomes higher than that of the connector portion because the junction box generates heat due to a conductor loss so that normal conductive transfer (quench) is partially caused. Consequently, the normally conductive transferred portion is broken instantly.

Even if the junction box is formed by a small-sized cable material such as a semi-rigid cable to cool the whole filter unit, the size of the filter apparatus is limited by the minimum bend radius of the semi-rigid cable and cannot be reduced. In addition, a heavy current flows to the cable and the filter connecting portion so that the temperature of the superconductive thin film is increased due to Joule heat generated by a contact resistance loss and a conductor resistance loss. Thereby, a critical current value is decreased so that the maximum output power is limited.

As described above, if the junction box is formed by using the coaxial line or the like, the size of the apparatus is increased and a large amount of heat supplied from the coaxial line is removed. For this reason, the size of the whole apparatus including a necessary large-sized freezer is considerably increased and becomes more expensive.

SUMMARY OF THE INVENTION

In order to solve the above problems, it is an object of the present invention to provide a high power filter apparatus used for a mobile communication base station or the like in which the temperature stability and frequency selection are excellent, an insertion loss is small, the size is small, power consumption is low and costs are low.

According to a first structure of the present invention, a low temperature operating filter apparatus comprises a shield case block having signal input and output portions and a plurality of closed spaces which have filter elements connected between the signal input and output portions, a heat insulating container which houses the shield case block, and a cooling plate provided in the heat insulating container, wherein the shield case block is fixed to the cooling plate in the thermal contact state.

According to such a structure, a plurality of filter elements are housed in the shield case block, and the shield case block is fixed to the cooling plate in the thermal contact state in the heat insulating container. Consequently, the size of the whole apparatus can be reduced while controlling a change in temperature of each filter element to the minimum. Even if the change in temperature is caused, the spacing of the resonant frequencies of the filters is kept almost constant as long as the filter element has the same temperature characteristics (such a structure can be obtained easily). Accordingly, the stability of the frequency can be enhanced by using the known means for monitoring the resonant frequency of the filter to control the temperature of the cooling plate.

It is preferred that the shield case block has a plurality of signal input and output portions and is formed by a plurality of shield cases having at least one closed space. In addition, it is preferred that the signal input and output lines of the filter element are connected to the signal input and output portions of the shield case block through a junction onto the substrate of the filter element or a wiring member embedded in the substrate.

Furthermore, the closed space for housing the filter element is kept in the vacuum state so that the filter element can be cooled stably. Furthermore, the closed space is filled with dry helium, neon or a mixture of helium and neon so that the filter element can be cooled uniformly without liquefaction at a temperature of about 30 Kelvin (K). In the case where the closed space is filled with dry argon, nitrogen, oxygen or a mixture of argon, nitrogen and oxygen, the filter element can be cooled uniformly without liquefaction to a liquefied nitrogen temperature (77.3 K) which can be obtained easily.

Preferably, each planar filter element is arranged almost in parallel, a cylindrical hole having an axis which is almost parallel with the face of each filter element penetrates the shield case block, a movable body is provided, the movable body having a screw portion which is screwed to a spiral groove formed on at least a part of the inner peripheral face of the cylindrical hole and moving in the axial direction of the cylindrical hole by rotation, the outer end portion of the movable body has an external force transmitting portion for giving the rotary force to the movable body, and the inner end portion of the movable body has a ground rod made of a conductor which changes the volume (electrical volume) of the closed space. According to such a structure, the movable body provided correspondingly to the filter elements are rotated on the outside of the shield case block and moved in the axial direction so that the resonant frequency of the filter element can be adjusted individually. In particular, it is easy to fine adjust the characteristics during cooling. Furthermore, a dielectric film or a dielectric block is fixed to the tip of the ground rod so that the adjustable frequency range can be increased according to the dielectric constant.

More preferably, the external force transmitting portion is rotated by driving means on the outside of the heat insulating container (it is more preferably that a rod having a small thermal transfer coefficient is used because heat insulating effects can be obtained). Consequently, the characteristics can be adjusted with precision during low temperature operation.

It is preferred that the filter element is formed by a thin film electrode provided on a dielectric substrate. In this case, the change in temperature of the characteristics of each filter element can be arranged easily and the the reduction of the size of the apparatus can be enhanced. Furthermore, the thin film electrode is made of a superconductive material, more particularly a high temperature oxide superconductive material so that the filter element having a high Q value can be obtained easily. In addition, a high critical current density can be obtained so that a small-sized filter having a power of several-tens W at a frequency of 2 GHz band can be implemented.

Furthermore, the inside of the heat insulating container is kept in the vacuum state and the cooling plate is connected to a heat transfer portion for transferring the heat of the shield case block to the outside of the heat insulating container so that the filter element can be cooled stably through the cooling plate. A coolant can be filled in the heat insulating container to cool the cooling plate and the shield case block. According to such a structure, cooling can be performed easily and with low costs.

According to a second structure of the present invention, the filter element forming a filter apparatus is characterized in that a filter electrode made of a superconductive thin film and a thin film coupling line having a length of $(2m+1)\lambda/4$ (wherein m is 0 or a natural number and $\lambda$ is a signal wavelength) which is connected to the output end of the filter electrode are formed on the same plane, a filter connecting line block held by two ground electrodes through a dielectric is laminated to form a filter block, the other end sides of the thin film connecting lines of the filter coupling line block are connected by conductive connecting means which extends in the direction of lamination to form a coupling portion, and an output coupling line having the same characteristic impedance as that of the thin film connecting line is connected to the coupling portion.

According to such a structure, the filter electrode made of a superconductive thin film and the thin film coupling line connected to the output end thereof are formed on the same plane to form a filter coupling line block held by two vertical ground electrodes through the dielectric. Consequently, a small-sized filter having a high Q value and a low loss can be integrated with the coupling line. The manufacturing steps of the filter is standardized and the fine adjustment of the frequency characteristics is standardized so that manufacturing time and other costs can be reduced.

By laminating the filter coupling line blocks to form the filter block, the coupling between the filter coupling line blocks is avoided by the ground electrode and the size of the whole apparatus can be reduced. Furthermore, the other end sides of the thin film coupling lines having a length of $(2m+1)\lambda/4$ of the filter coupling line block are connected by conductive connecting means which extends in the direction of lamination, that is, a via hole (through hole) to form a coupling portion. The output coupling line having the same characteristic impedance as that of the thin film coupling line is connected to the coupling portion so that a plurality of filters can be merged by a thin film lamination structure.

It is preferred that the filter electrode made of the superconductive thin film is formed by an oxide superconductive thin film. In this case, it is easy to perform cooling because the operating temperature can be set to about a liquefied nitrogen temperature. More preferably, even if the oxide superconductive thin film having a low heat conductivity is partially quenched (that is, superconductive characteristics are lost) by using the superconductive electrode having a metallic thin film formed on the oxide superconductive thin film, there is the bypass of the metallic thin film so that the melting of the oxide superconductive thin film can be prevented.

In order to hierarchically merge the outputs of multichannel filters to obtain an output similarly to a junction box according to the prior art, it is preferred that the filter block is divided into a plurality of groups comprised of a plurality of filter coupling line blocks, the other end side of the thin film coupling lines are connected by first conductive connecting means which extends in the direction of lamination to form a first coupling portion every group, a first output coupling line having a length of $n\lambda/2$ (n is a natural number and $\lambda$ is a signal wavelength) whose characteristic impedance is the same as that of the thin film coupling line is connected to the first coupling portion, the other end sides of the first output coupling lines of each group are connected by second conductive connecting means which extends in the direction of lamination to form a second coupling portion, and a second output coupling line having the same characteristic impedance as that of the first output coupling line is connected to the second coupling portion. Thus, it is possible to implement a very small-sized filter apparatus having a low loss, a high Q value and a thin film structure in which the filter circuit and the junction box according to the prior art are integrated.

It is more preferable that at least one of the dielectric constant and the thickness of the dielectric which encloses the output coupling line is different from those of the filter block so that the width of the output coupling line is increased while maintaining a predetermined characteristic impedance. Consequently, an increase in current density can be relaxed with signal merging so that the power of the whole superconductive filter apparatus can be increased.

According to a third structure of the present invention, the low temperature operating filter apparatus is characterized in that the filter element forming the filter apparatus has a structure in which a superconductive filter made of a superconductive thin film which is provided on a base substance A is connected to a junction box made of a thin film conductor which is provided on a base substance B, a transmission line conductive forming the junction box has the same characteristic impedance as that of a transmission line forming the superconductive filter, and the sectional area of the transmission line forming said junction box is greater than that of the transmission line conductor of the superconductive filter.

According to the above structure, it is possible to implement a superconductive filter apparatus for a high power which includes the superconductive filter and the junction box. More specifically, the transmission line forming the junction box is greater than the transmission line forming the filter which is provided on another base substance so that the transmission conductor has a greater sectional area. In particular, the base substance of the junction box is thicker than that of the filter and the dielectric constant of the base substance of the junction box is set smaller than that of the base substance of the filter to set the transmission line greater so that the sectional area of the transmission conductor is increased. According to a thin film type junction box in which the sectional area of the transmission conductor is increased by setting the transmission line greater, heat can be prevented from occurring in the case where a metal is used as a thin film conductor. Furthermore, in the case where a superconductor is used as a thin film conductor, a current which exceeds a critical current can be prevented from flowing. Preferably, the thin film conductor is formed by the oxide superconductor, a metal or their lamination structure so that higher power can be utilized.

According to a fourth structure of the low temperature operating filter apparatus of the present invention, the filter element has a structure in which a filter aggregate formed by a plurality of plane circuit filters made of a superconductive thin film filter electrode is connected to a junction box formed by a branch line which is provided on a substrate by a plurality of connecting terminals and fixed so as to come in contact with the common cooling face, and the junction box is arranged in such a manner that a plane including the junction box intersects the face of each plane circuit filter, each connecting terminal includes a connecting conductor which has a first contact face parallel with the face of the plane circuit filter on one of end sides and a second contact face parallel with the face of the junction box on the other end side.

According to such a structure, it is possible to implement a small-sized filter apparatus having a low loss, a high power and a high Q value in which filters are provided in three dimensions. Furthermore, a variation in temperature among filters is small which contributes to the characteristic stability. Each plane circuit filter intersects a plane junction unit, preferably, they are almost orthogonal to each other and their connection is performed by a connecting conductor (connecting terminal) having first and second contact faces on both ends. Consequently, the three-dimensional arrangement structure for the reduction of the size can be compatible with the continuity of the impedance of the connecting portion (the reduction of a Joule loss obtained by a contact resistance, a conductor loss and the like).

The first contact face is parallel with the face of the plane circuit filter, and the second contact face is parallel with the face of the junction unit. Consequently, the filter electrode of the plane circuit filter and the first contact face, and the branch line of the junction unit and the second contact face can come in contact with each other so that the continuity of the impedance on the connecting portion can be obtained.

It is also preferred that a conductive material such as a metal, a superconductor or a conductive resin is provided between the first contact face and the filter electrode of each plane circuit filter and/or between the second contact face and the branch line of the junction box. Consequently, the contact resistance on each connecting portion can be reduced more and the stability of the electric characteristics of each connecting portion can be enhanced for the change in temperature caused by cooling.

According to a fifth structure of the low temperature operating filter apparatus of the present invention, a junction box included in each filter element has at least one of the structures in which filter output connecting portions A, B, C and D which are arranged in this order, a first merging point E provided at a distance of $(2n+1)\lambda/4$ from the filter output connecting portions A and B, a second merging point F provided at a distance of $(2n+1)\lambda/4$ from the filter output connecting portions C and D and present on a plane which is formed by the filter output connecting portions A and B and the first merging point E, and a third merging point G at a distance of $(m+1)\lambda/2$ from the first and second merging points E and F and present on the plane and provided, and at least three of the filter output connecting portions A, B, C and D are connected to the first, second and third merging points E, F and G by straight branch lines having the form of a thin film attached to a base substance and the same characteristic impedance (wherein $\lambda$ is a wavelength at the average resonant frequency of a filter, and n and m are 0 or natural numbers).

According to such a structure, it is possible to form the junction box on the plane by using an isosceles triangle structure for merging the filter output connecting portions A and B to the first merging point E, an isosceles triangle structure for merging from the filter output connecting portions C and D to the second merging point F, and an isosceles triangle structure for merging from the first and second merging points E and F to the third merging point G. The transmission lines having the same width formed on the base substance which is uniform and has no film thickness distribution have the same characteristic impedance and phase constant. Consequently, a real length is proportional to an electric length. Accordingly, it is possible to form a coupling line having an electric length of $(2n+1)/\lambda$ by using the three isosceles structures. Thus, it is possible to implement a small-sized thin film type junction box having a low loss.

According to the fifth structure, it is preferred that the filter output connecting portions A, B, C and D are arranged on a straight line at regular intervals, and the third merging point G is placed on a position where a straight line for connecting the filter output connecting portion A to the first merging point E intersects a straight line for connecting the filter output connecting portion D to the second merging point F. Consequently, a radiation loss can be prevented from occurring due to the bend of the branch lines on the first and second merging points E and F.

The junction box has at least one fan-shaped structure in which at least two filter output connecting portions are arranged like an arc and the centers of the arc are connected by a straight branch line having the form of a thin film attached to a base substance and a length of $(2n+1)\lambda/4$ whose characteristic impedance is the same (wherein $\lambda$ is a wavelength at the average resonant frequency of a filter, and n is 0 or a natural number).

According to such a structure, the filter output connecting portions are arranged like an arc and the merging points are the centers of the arcs so that the filter output connecting portions are provided at an equal distance from the merging points to form the fan-shaped structure. In addition, it is possible to merge from a plurality of filter output connecting portions to a merging point at the same time. The transmission line having the same width formed on a base substance which is uniform and has no film thickness distribution has the same characteristic impedance and phase constant. Consequently, a real length is proportional to an electric length. Accordingly, it is possible to form the coupling line having an electric length of $(2n+1)/\lambda$ on the same plane by using the fan-shaped structure. Consequently, it is possible to implement a small-sized thin film type junction box having high performance (e.g. a low loss). Furthermore, a sufficient space can be kept among the filter output connecting portions so that it is possible to form a filter on the same base substance as the junction box.

It is preferred that the junction box has at least one of structures in which at least two fan-shaped structures are provided on the same plane, the centers of the arcs of the fan-shaped structures are connected by a straight branch line having the form of a thin film attached onto a base substance and a length of $(m+1)\lambda/2$ whose characteristic impedance is the same (wherein m is 0 or a natural number).

According to the structure of the junction box, in the case where $LaAlO_3$, $SrTiO_3$, $LaGaO_3$, $NdGaO_3$ and the like are used for the base substance, the mismatching of a lattice constant between the base substance and the branch line (oxide superconductor) is reduced so that the crystalline properties of the branch line (oxide superconductor) can be enhanced. As a result, a critical temperature and a critical current density can be improved so that the power of a freezer can be reduced. In addition, microwaves having a high power can be utilized. By forming the branch line with the layered product of the oxide superconductor and the metal, the heat transmission can be ensured by the metal even if the superconductor loses the superconductivity due to freezer failure. Consequently, the functions are not completely lost so that the stability of the junction box can be enhanced.

As described above, the present invention provides a small-sized low temperature operating apparatus having a low loss and a high power in which the temperature stability and frequency characteristics are excellent. In particular, a small-sized superconductive filter element having a low loss, a high Q value and a high power in which a resonator filter and a portion corresponding to a junction box are integrated by thin film technology using a superconductive material so that the reduction of the size and the performance can be enhanced still more. Furthermore, a plurality of plane circuit filters in which each filter electrode is made of a superconductive thin film material and a junction unit are arranged in three dimensions so that a small-sized low temperature operating filter apparatus having a low loss and excellent cooling efficiency can be implemented.

DETAILED DESCRIPTION OF THE INVENTION

Preferred embodiments of the present invention will be described below with reference to the drawings.

Figure 1:
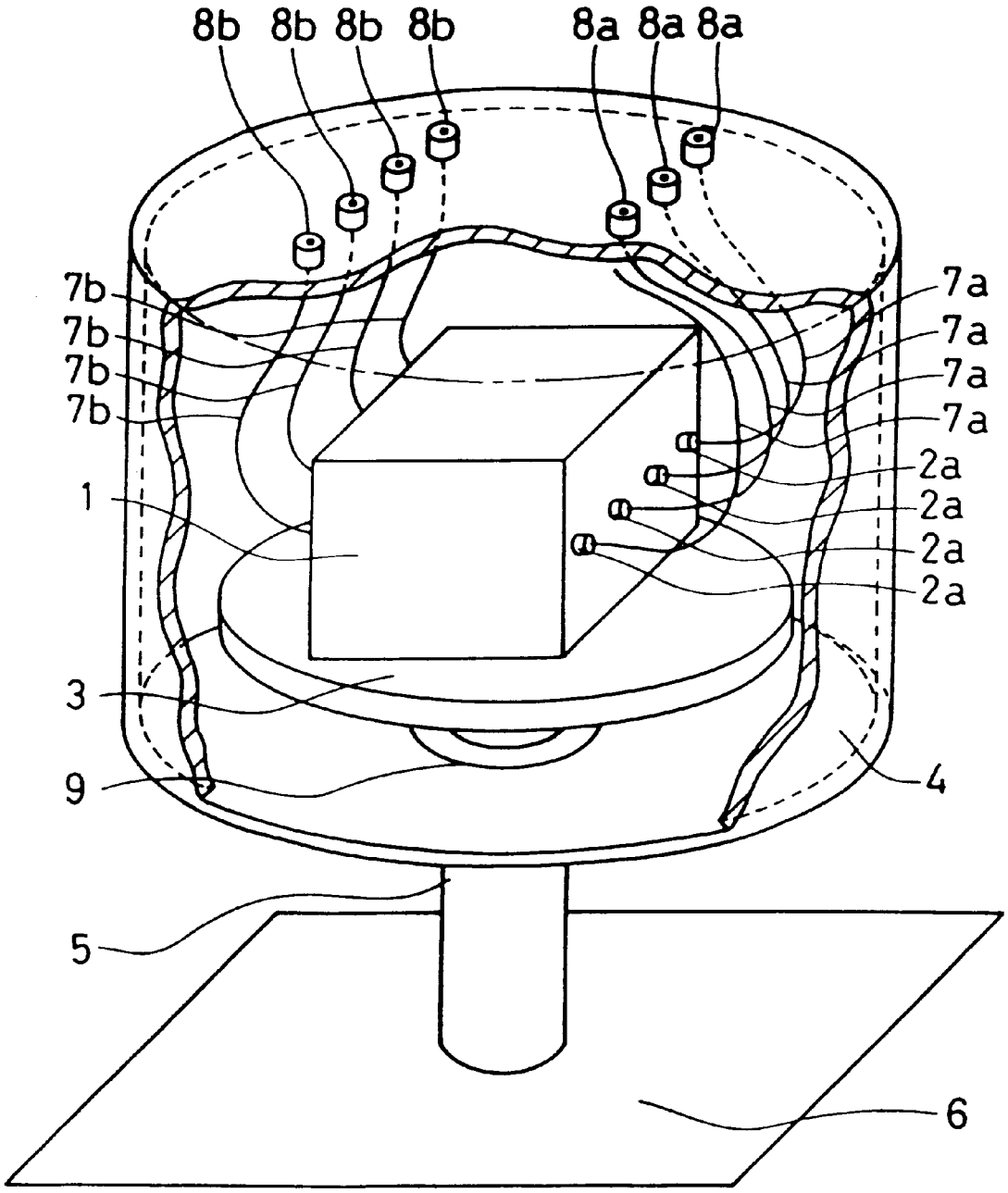
FIG. 1 is a perspective view showing the overall structure of a low temperature operating filter apparatus according to a first example of the present invention, which is partially cut out.

FIG. 1 shows the overall structure of a low temperature operating filter apparatus according to a first example of the present invention. The low temperature operating filter apparatus comprises four filter elements. The four filter elements are housed in a closed space on the inside of a shield case block 1. The shield block 1 comprises four signal input portions 2*a* and four signal output portions 2*b* (see FIG. 2). The shield case block 1 has a bottom fixed to a cooling plate 3 in the thermal contact state in such a manner that heat transfer can easily be obtained. A heat conductive grease is injected into a heat contact fixing portion between the shield case block 1 and the cooling plate 3 so that heat conductivity is enhanced. The cooling plate 3 is connected and fixed to one of ends of a heat conductive portion 5 in a heat insulating container 4. Consequently, heat which is transferred from the shield case block 1 to the cooling plate 3 is caused to escape to a low-temperature portion 6 connected to the other end of the heat conductive portion 5.

The heat conductive portion 5 is fixed to the heat insulating container 4 through heat insulating material 9 so that the heat is not transferred from the heat insulating container 4 to the heat conductive portion 5. The space in the heat insulating container 4 is brought to the vacuum state around the shield case block 1. Consequently, heat insulation can be performed effectively. The low temperature portion 6 is cooled by a freezer. In place of heat insulation and cooling, a coolant such as liquid nitrogen may be filled in the heat insulating container 4 to cool the cooling plate 3 and the shield case block 1. Such a structure is convenient and effective.

Figure 2:
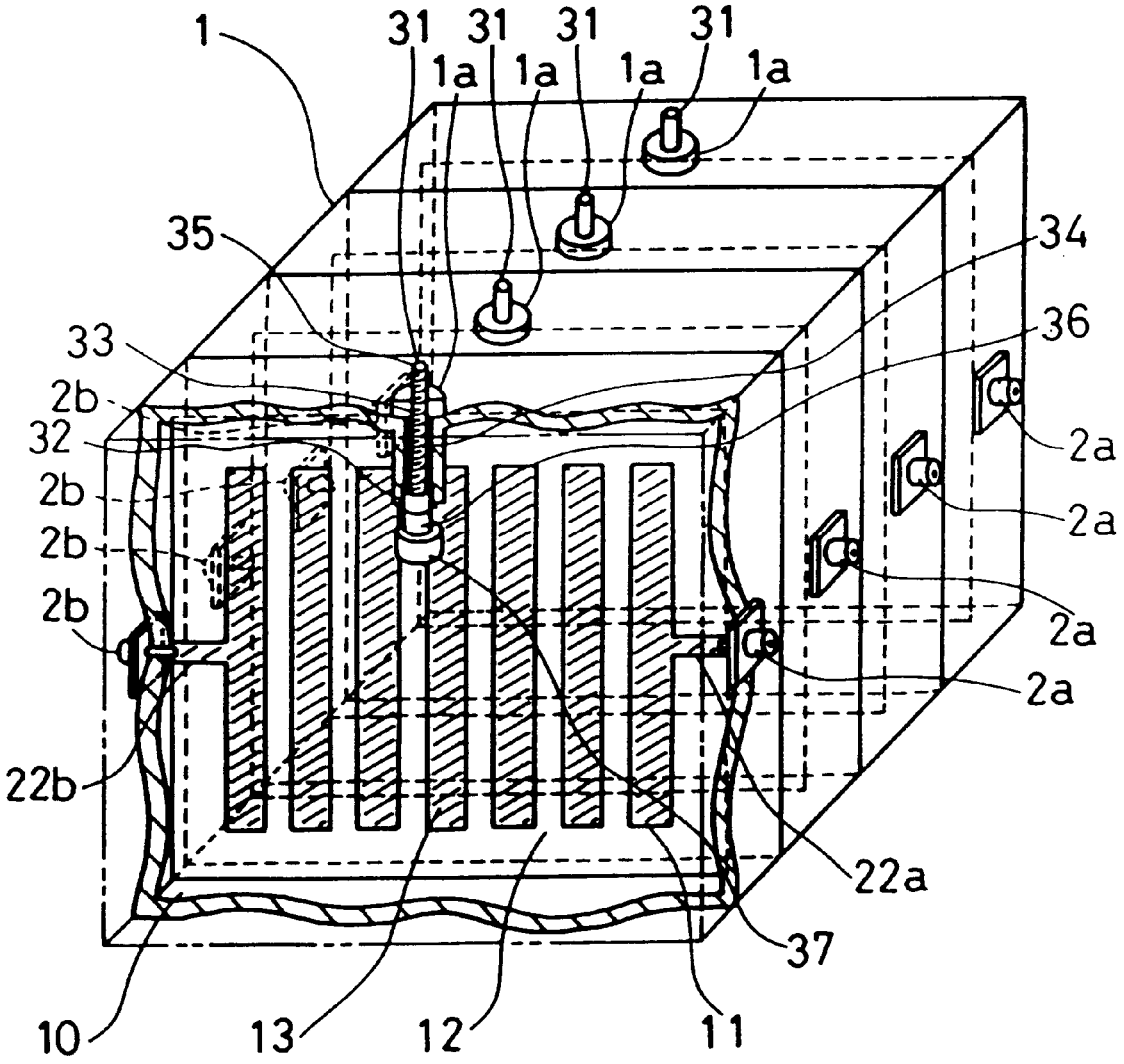
FIG. 2 is a perspective view showing a specific example of a shield case block forming the low temperature operating filter apparatus shown in FIG. 1, which is partially cut out.

Four signal input portions 2*a* (as shown in FIG. 2) are connected to four input terminals 8*a* provided on the heat insulating container 4 through four cables 7*a*. Four signal output portions 2*b* (as shown in FIG. 2) are connected to four output terminals 8*b* provided on the heat insulating container 4 through four cables 7*b*. Accordingly, a signal input from one of the input terminals 8*a* passes through the cable 7*a* and the signal input portion 2*a* and then through one of filter elements in the shield case block 1. Thereafter, the signal is output from one of the output terminals 8*b* through one of the signal output portions 2*b* and one of the cables 7*b*. In this case, only a signal at the passing frequency band of the filter element passes through the filter element to the output terminal 8*b*.

According to the present example, four filter elements are housed in the shield case block 1. It is necessary to prevent cross talk from occurring between the filter elements. A space for housing each filter element is closed and each filter element is connected to the signal input portion 2*a* and the signal output portion 2*b* through each cable. Consequently, such a structure features that a connection between filters is avoided and respective filter elements are stable.

FIG. 2 is a perspective view showing the structure of the shield case block 1, which is partially cut out. In the shield case block 1, four closed spaces 10 comprising one of the signal input portions 2*a* and one of the signal output portions 2*b* are collected into one. The filter elements 11 are housed one by one in each closed space 10. The planar filter elements 11 are provided in almost parallel with each other. The signal input line 22*a* of the filter element 11 is connected to the signal input portion 2*a*. The signal output line 22*b* is connected to the signal output portion 2*b*. The heat conductive grease or the like is applied so as to reduce a heat resistance so that the filter element 11 is fixed to the shield case block 1 by pressing contact with a screw, a spring or the like. Consequently, radiation efficiency of the heat generated on the filter element 11 is increased so that the operating stability of the filter element 11 can be enhanced.

The shield case block 1 can be divided vertically into two portions so that the assembly work for incorporating the filter element in the closed space of the shield case block 1 can be performed more easily. In this case, the shield case block 1 is divided into two portions, and the filter element, the signal input portion 2*a* and the signal output portion 2*b* are then incorporated in each closed space. Thereafter, the shield case block 1 is combined and sealed. Consequently, the shield case block 1 is obtained. Furthermore, the shield case block 1 may be formed as an aggregate of the shield cases. In this case, each filter element is attached and sealed for every shield case. Then, the shield cases are integrated to make the shield case block 1. Thus, the assembly work can be performed easily.

The closed space of the shield case block 1 may be filled with dry He gas, Ne gas or a mixture of He gas and Ne gas, or dry Ar gas, $N_2$ gas, $O_2$ gas or a mixture of Ar gas, $N_2$ gas and $O_2$ gas so as to enhance the temperature stability of the filter element 11. In case of vacuum, the gas can be used within all temperature ranges. In the case where Ar gas, $N_2$ gas, $O_2$ gas or a mixture of Ar gas, $N_2$ gas and $O_2$ gas is used for the operation at a temperature which is higher than the temperature of a liquid nitrogen, they are not liquefied and the filter element 11 is effectively cooled by convection. The above effects can be obtained before He gas, Ne gas or a mixture of He gas and Ne gas is liquefied at a temperature which is lower than the temperature of the liquid nitrogen. In particular, the He gas can be used until the temperature (4.2 K) of liquefied He is reached.

As shown in FIG. 2, contact pins which protrude from the signal input portion 2*a* and the signal output portion 2*b* to the inside come in contact with the signal input portion 2*a* or the signal output portion 2*b* on a dielectric substrate 12 so that the signal input line 22*a* and the signal output line 22*b* of the filter element 11 are connected to the signal input portion 2*a* and the signal output portion 2*b* of the shield case block 1, respectively. The signal input line 22*a* and the signal output line 22*b* of the filter element 11 may be connected to each other through a wiring member (such as a flexible wiring plate or lead wire) which is joined onto the the dielectric substrate 12 of the filter element 11 or embedded in the substrate 12.

As shown in FIG. 2, four through holes are formed on the upper wall of the shield case block 1. Cylindrical members 1*a* are attached to the through holes. The cylindrical member 1*a* also has a through hole which includes an axis that is almost parallel to the substrate face of the filter element 11. A movable member 31 for fine adjusting the frequency characteristics of the filter element 11 is inserted in the through hole of the cylindrical member 1*a*. The movable member 31 has a screw 34 which is screwed to a spiral groove 33 provided on a part of the through hole. An external force transmitting portion 35 for giving rotary force to the movable member 31 is formed on the outer end of the movable member 31. A lubricant is inserted between the movable member and the other portion of the through hole so that a sliding portion 32 is formed. Consequently, the airtightness of the closed space 10 in the shield case block 1 is held and the shield case block 1 is electrically connected to a ground rod 36 of the movable member 31 through an electrostatic capacity. A ground rod 36 made of a conductor which changes the volume of the closed space 10 is provided on an inner end (an end on the closed space 10 side). A dielectric block 37 is fixed to the tip of the ground rod 36.

A cylinder portion having a greater diameter than that of the screw portion 34 is formed on the inner end side of the through hole of the cylindrical member 1*a*. A piston portion which is fitted in the cylinder portion is provided on the movable member. The sliding portion 32 is formed by the cylinder portion and the piston portion.

The external force transmitting portion 35 has the shape of a hexagonal screw. When a tool is provided around the external force transmitting portion 36 and rotated, the ground rods 36 goes into or out of the closed space 10 by the screw movement of the screw portion 34 and the spiral groove 33 of the through hole. The shape of the closed space 10 is changed by the movement of the ground rod 36 and the electric field distribution formed in the closed space 10 is changed by a signal which passes through a filter element 11. The frequency characteristics of the filter element 11 is fine tuned. Thus, the frequency characteristics can be finely adjusted. According to such a structure, the frequency characteristics for the filter elements can be finely adjusted in the same direction. Consequently, it is easy to perform fine adjustment with the filter element cooled to an operating temperature.

A rotating mechanism connected to the external force transmitting portion 35 through a rod made of a high thermal insulating PTFE (etylene tetrafluoride) resin is provided, as means for transmitting a torque from the outside of the heat insulating container 4 (as shown in FIG. 1), on the external wall face of the heat insulating container 4 so that the characteristics can be finely adjusted during cooling operation. Thus, adjustment can be performed more easily.

For convenience of assembly, the cylindrical member 1*a* is provided in such a manner that the length of the through hole which slides with the movable member 31 is increased as much as possible, and is attached to the hole of the case wall after being screwed to the movable member 31 in advance. Accordingly, the cylindrical member 1*a* is not always required. The spiral groove and the sliding portion may be formed on the through hole provided on the case wall to directly insert the movable member 31 in the through hole. The number of the movable members 31 is not limited for each filter element. A plurality of the movable members are provided in different places so that adjustment can be performed much finer.

The dielectric block 37 may be replaced with a dielectric film or is not necessary in some cases. However, since the dielectric constant of the dielectric 37 is great (about 3 in case of TEFLON (synthetic fluorine-containing resins) (Trademark), about 9 in case of alumina), an electric field concentrates on the inside of the dielectric 37. In the case where the insulator 37 is provided, the amount of adjustment of the frequency characteristics for the unit displacement of the movable member can be increased as compared with the case where the dielectric 37 is not provided.

The filter element 11 has a thin film electrodes 13 formed like a strip line filter pattern on the surface of a dielectric substrate 12, and ground electrodes formed over the back face. In the case where an electrode material such as Cu, Ag or Au is used as the material of the thin film electrode 13 at an operating temperature which is in the vicinity of an ordinary temperature, the Q value of the filter element is at most several hundreds. If the electrode material is cooled to a low temperature, for example, a liquefied nitrogen temperature (77.3 K), a resistivity is considerably reduced so that the Q value is increased to several thousands at a frequency of about 2 GHz. Furthermore, in the case where a superconductive material is used as the material of the thin film electrode 13 in the superconductive state by cooling, the Q value is increased to several ten thousands at a frequency of about 2 GHz. In addition, in the case where a high temperature oxide superconductive material such as a bismuth system, a yttrium system or a thallium system is used as the superconductive material of the thin film electrode 13, the operating temperature, that is, the temperature in the superconductive operating state can be raised much higher than the low temperature superconductive material such as Nb, Nb—Ti or $Nb_3Sn$. Consequently, cooling can be performed more easily. Since a critical current density is high, i.e., about $10^5$ to $10^7$ A/cm$^2$, a high power filter can be formed.

As another example, lanthanum aluminates ($LaAlO_3$, a lattice constant: a-axis 5.365 angstrom, c-axis 13.11 angstrom, a dielectric constant: about 24) is used for the material of the dielectric substrate 12, and a thallium-2212 phase (a critical temperature ~110 K) is used for the material of the thin film electrode 13 so that a circular filter pattern having a diameter of about 24 mm is formed. Thus, the filter element 11 is formed. The shield case block 1 is cooled to about 70 K by the cooling plate 3 connected to the low-temperature portion 6 of the freezer and is then operated. Consequently, the electric loss of a passing signal at a frequency band of about 2 GHz can be decreased to several tens of Watts.

While the example in which a filter of a strip line type and a circular filter are used for the thin film filter has been described above, the same effects can be obtained also in the case where other thin film filters such as a co-planar filter are used.

The dimension of the shield case block 1 having four filter elements according to the present example is about 50 mm width (W)×30 mm depth (D)×30 mm height (H). The outer dimension of the heat insulating container is about 70 mm diameter (ϕ)×60 mm height (H). Since a filter apparatus having the same performance which uses a dielectric resonator according to the prior art has a dimension of about 200 mm width (W)×200 mm depth (D)×150 mm height (H), the size thereof can be reduced to have about half of a capacity ratio. When a sterling cycle freezer is used as means for cooling the cooling plate 3, the space having a dimension of about 120 mm width (W)×70 mm depth (D) mmD×170 mm height (H) mmH. Also in this case, the size can generally be reduced to about ⅓ or less.

While an example in which the low temperature filter apparatus comprises four filter elements in the shield case block has been described above, the present invention is not restricted thereto. For example, a low temperature operating filter apparatus in which a plurality of filters and junction boxes are incorporated in a shield case block to be described below is included within the scope of the present invention.

While the thallium-2212 phase high temperature oxide superconductive thin film has been used as a superconductive thin film in the above example, other high temperature oxide superconductive thin film having the same functions may be used. While the thin film resonator has been used in the above example, the present invention is not limited thereto. A dielectric resonator may be housed in the closed space 10 on the inside of the shield case block 1. In this case, the dimension is increased.

Figure 3:
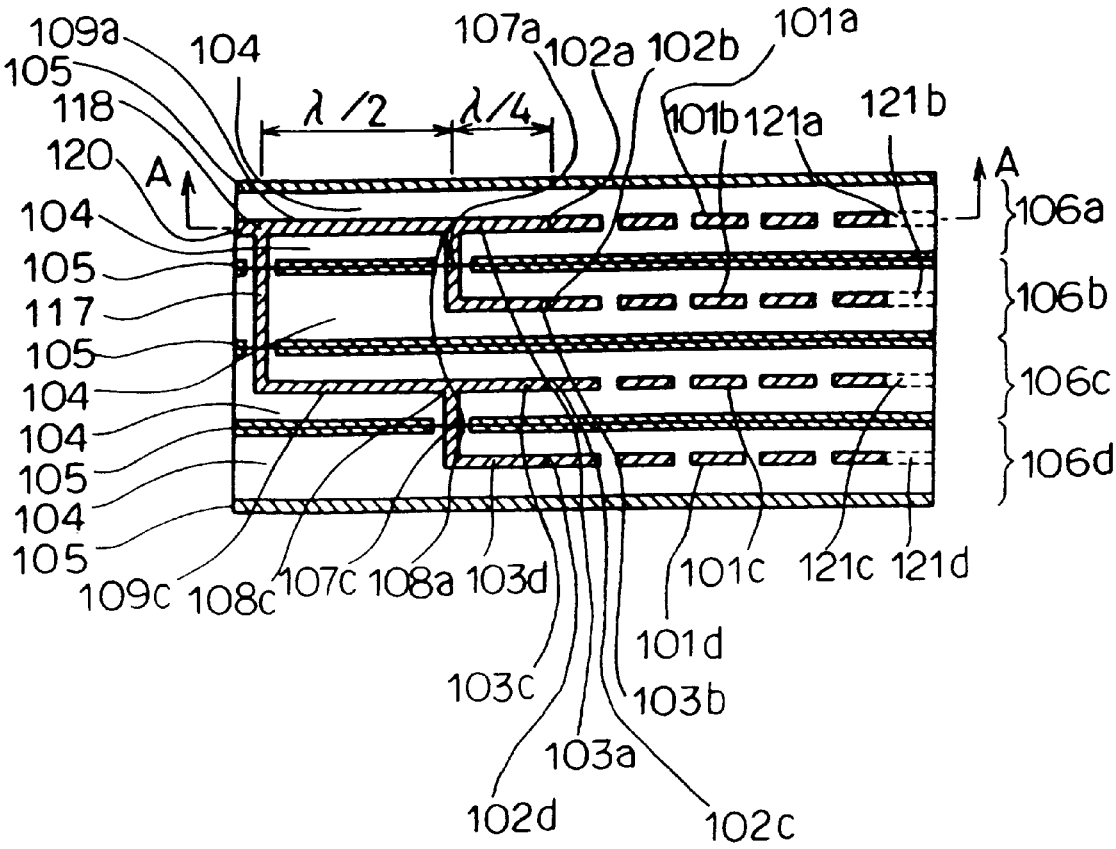
FIG. 3 is a sectional view typically showing a superconductive filter element, seen from the side, of a low-temperature operating filter apparatus according to a second example of the present invention (a B—B section in FIG. 4)
Figure 4:
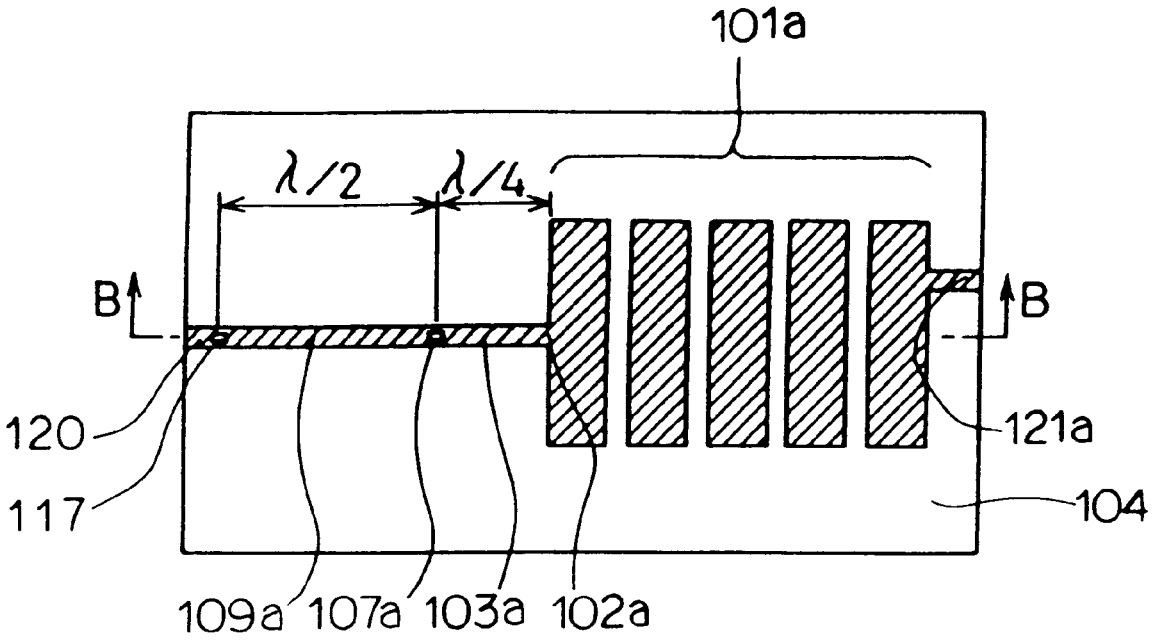
FIG. 4 is a sectional view showing the superconductive filter element in FIG. 3 seen from the top face (an A—A section in FIG. 3)

A low temperature operating filter apparatus according to a second example of the present invention will be described below, wherein filter elements are integrated. FIG. 3 is a sectional side view showing filter elements according to the present example. FIG. 4 is a sectional plan view showing the filter elements according to the present example. FIG. 3 is a B—B sectional view of FIG. 4. FIG. 4 is an A—A sectional view of FIG. 3.

As shown in FIG. 3, the filter element has a four-layer structure in which the filter element uses a superconductive thin film for a filter electrode material. As seen from FIG. 4, the top layer has a structure in which a superconductive filter electrode 101*a* and a thin film coupling line 103*a* having a length of λ/4 connected to an output end 102*a* are formed on the same plane (A—A plane). The superconductive filter electrode 101*a* and the thin film connecting line 103*a* are vertically held by two ground electrodes 105 through a dielectric 104 so that a filter coupling line block 106*a* is formed. It is sufficient that the coupling line 103*a* has the same characteristic impedance (50Ω) as that of an input line 121*a*, and has a length of (2m+1)λ/4 (m is 0 or a natural number, and λ is a signal wavelength) in consideration of characteristics. According to the present example, the length of λ/4 corresponds to m=0.

Similarly, filter coupling line blocks 106*b*, 106*c*, 106*d* having the same structure are formed on the other three layers. The filter coupling line blocks 106*a*, 106*b*, 106*c*, 106*d* are laminated to form a filter element. It is not always required that the two ground electrodes 105 are stuck together. A ground electrode 105 may be shared by the filter coupling line blocks which are provided vertically. It is desired that the superconductive thin film is used for the contact electrode material because it has excellent filter characteristics. It is also desired that a metallic thin film is used for the contact electrode material because it is cooled to a low temperature so that a resistance is considerably reduced and the filter characteristics can be improved remarkably as compared with the ordinary temperature operation.

According to the present example, the filter elements are divided into two groups which have two filter coupling line blocks respectively (106*a* and 106*b*, 106*c* and 106*d*). The other end sides of the coupling lines 103*a* and 103*c* are connected by via holes (through holes) 107*a* and 107*c* as first conductive coupling means which extends in the direction of lamination so that first coupling portions 108*a* and 108*c* are formed. First output coupling lines 109*a* and 109*c* having a length of λ/2 and the same characteristic impedance as those of the thin film coupling lines 103*a* and 103*c* are connected to the first coupling portions 108*a* and 108*c*. It is sufficient that the first output coupling lines 109*a* and 109*c* have a length of nλ/2 (n is a natural number and λ is a signal wavelength) in consideration of characteristics. According to the present example, the length λ/2 corresponds to n=1.

Furthermore, the other end sides of the first output coupling lines 109*a* and 109*c* of each group are connected through a via hole 117 as second conductive connecting means which extends in the direction of lamination so that a second coupling portion 118 is formed. A second output coupling line 120 having the same characteristic impedance as those of the first output coupling lines 109*a* and 109*c* is connected to the second coupling portion 118.

According to the above structure, a filter block and an element corresponding to a junction box are integrated to form a filter element having the structure of a superconductive electrode. The filter block is formed by laminating a plurality of filter coupling line blocks having a superconductive filter electrode and a thin film coupling line. The element corresponding to the junction box is formed by hierarchically connecting the output coupling lines. The ground electrode 105 provided on a portion where through holes 107*a*, 107*c* and 117 penetrate has holes having suitable diameters for insulation from the via holes. The ground electrodes are connected to each other by other via holes (not shown).

With reference to the plan view (A—A sectional view) of FIG. 4, the filter coupling line block 106*a* will be described supplementarily. As shown in FIG. 4, an input line 121*a* is connected to the input side of the superconductive filter electrode 101*a*. Similarly, input lines 121*b*, 121*c*, 121*d* are connected to other filter coupling line blocks 106*b*, 106*c*, 106*d* (see FIG. 3). A thin film coupling line 103*a* having a length of λ/4 and the same characteristic impedance (50Ω) as that of the input line 121*a* is connected to the output end 102*a* of the superconductive filter electrode 101*a*. The via hole 107*a* is provided on the other end side (a first coupling portion 108*a*) and connected to the first output coupling line 109*a* having a length of λ/2 and the same characteristic impedance as that of the input line 121*a*. A via hole 117 is provided on the tip end of the other end side (the second coupling portion 108*c*) of the output coupling line 109*a* to which the output line 120 (50Ω) having the same characteristic impedance as that of the input line 121*a* is connected.

The superconductive filter electrode 101*a* has the shape of a five-polar strip line type resonator filter. If the same function is obtained, the superconductive filter electrode 101*a* can take any shape of the patterned thin film. The positions of the input lines 121*a* to 121*d* of each filter coupling line block are alternately shifted and placed zigzag so that a transmitter can be connected to an amplifier more easily.

The output line 120 can be provided on any filter coupling line block. In the case where the output line 120 is provided on the top layer, a connection to an output cable can be performed easily. The lengths of the thin film coupling line and the output coupling line should be designed in consideration of the length of the via hole. Usually, the via hole is much shorter than each line. If the number of layers is increased so that the via hole becomes much longer, it is necessary to adjust the length by changing each line pattern every filter coupling line block.

According to the above example, the filter element has a structure in which a filter block comprised of four filter coupling line blocks is divided into two groups, each group having two filter coupling line blocks, and the outputs of the four superconductive filter electrodes are merged in stages by the thin film coupling line and the first and second output coupling lines and then reach one of the output lines 120. The present invention is not limited to the above example. In other words, the numbers of the output coupling lines and thin film coupling lines which are connected by the via holes on junctions can be selected. One-stage connection in which a plurality of thin film coupling lines are connected to one another by via holes and directly connected to the output line (the final output coupling line) and at least three-stage connection are included within the scope of the present invention.

An example of a method for manufacturing a filter element according to the above example will be described below. In this example, an oxide high temperature superconductive material is used for a superconductive electrode material and two dielectric substrates are stuck as the dielectric 104. First of all, lanthanum aluminates ($LaAlO_3$, lattice constant: a axis 5.365 angstrom, c axis 13.11 angstrom, dielectric constant: about 24) are used for the dielectric substrate, on which a high temperature oxide superconductive thin film material having a thallium 2212-phase (critical temperature ~110 K) is formed. By using the known technology, the high temperature oxide superconductive thin film material is processed into a desired pattern shown in FIG. 4. The pattern is divided into two on the via hole 107*a* relative to the substrate dimension which is used. If a big substrate is used, the patterns can be integrated.

The pattern of the superconductive filter electrode of the filter coupling line block is designed so as to have passband frequencies which differ slightly from one another. The filter coupling line blocks 106*b* to 106*d* have no superconductive thin film line pattern corresponding to the second output coupling line 120. In addition, the filter connecting line blocks 106*b* and 106*d* have no superconductive thin film line pattern corresponding to the first output coupling line.

A high temperature oxide superconductive thin film is provided on the surface of another dielectric substrate to form a ground electrode. The high temperature oxide superconductive thin film where the via hole penetrates is etched by Ar ion milling. A little bigger hole is formed to have a smaller floating electrostatic capacity. Furthermore, a through hole having a dimension whose characteristic impedance is close to the characteristic impedance of the thin film coupling line is processed, by a carbon dioxide gas laser processing machine, on the dielectric substrate on which the filter superconductive thin film electrode is formed and a portion of the dielectric substrate having the ground electrode where the via hole penetrates.

The filter electrode formation substrate of the filter coupling line block and the ground electrode formation substrate are mounted together in the direction having a structure shown in FIG. 3 so that each filter coupling line block is produced. The characteristics are measured by cooling, and trimmed by scraping the superconductive filter electrode little by little, laser trimming using YAG laser irradiation or the like. When the substrates are mounted together, a gap portion having a dielectric constant of about 1 is formed on a portion having no superconductive thin film electrode pattern. Since the thickness of the superconductive thin film electrode is very small (several hundreds nm), the characteristics are seldom affected. The dielectric material having the same dielectric constant as that of the dielectric substrate is formed on the superconductive thin film electrode by sputtering, and is subjected to flattening and polishing. The substrates are mounted together with optical precision. Consequently, the influence on the characteristics can be eliminated.

The mounted substrates are divided again. A normal conductive metal such as Cr/Au, Cu or Ag is formed as a thin film on the via hole portion. As another method, the superconductive thin film may be formed in the via hole or the via hole may be filled with a conductive paste, a conductive resin or the like. Furthermore, a conductor such as metal or a superconductive rod may be inserted and connected by a metallic thin film, a conductive paste, a resin or the like. Thus, the substrates having processed via hole portions are mounted again to form a filter coupling line block. The filter coupling line blocks are superposed so that the filter block is formed. Contact is enough to connect the via holes between the adjacent filter coupling line blocks. If metallic foils, conductive pastes or resins are used, the connection can be ensured still more. The metallic thin film is formed by deposition on the substrate end faces of the input lines 121*a* to 121*d* and the second output coupling line 120 so that a connection to an input-output line can be ensured by press contact. If the connection can be performed without the metallic thin film (deposition film), there is no problem.

The superconductive filter element having 4-channel filter shown in FIG. 3 has a dimension of about 65 mm width (W)×35 mm depth (D)×4 mm height (H) for 1.5 GHz. The superconductive filter element is housed in the shield case having an input-output connector. The shield case is mounted on the heat insulating container so that a low temperature operating filter apparatus is formed. When the freezer is ground and operated at about 70 K, higher performance can be obtained than that of a dielectric resonator filter apparatus according to the prior art. The volume of the whole system including the freezer is about one-third of that of the dielectric resonator filter apparatus having the same function according to the prior art. Consequently, the size can be reduced considerably. An insertion loss is less than several W per channel for a signal input of about 10 W. Power consumption is less than half of that of the apparatus according to the prior art. Also in consideration of a power loss of the amplifier of a transmitter or the like for the whole transmitting portion of a mobile communication base station system, the power consumption can be reduced remarkably.

Figure 5:
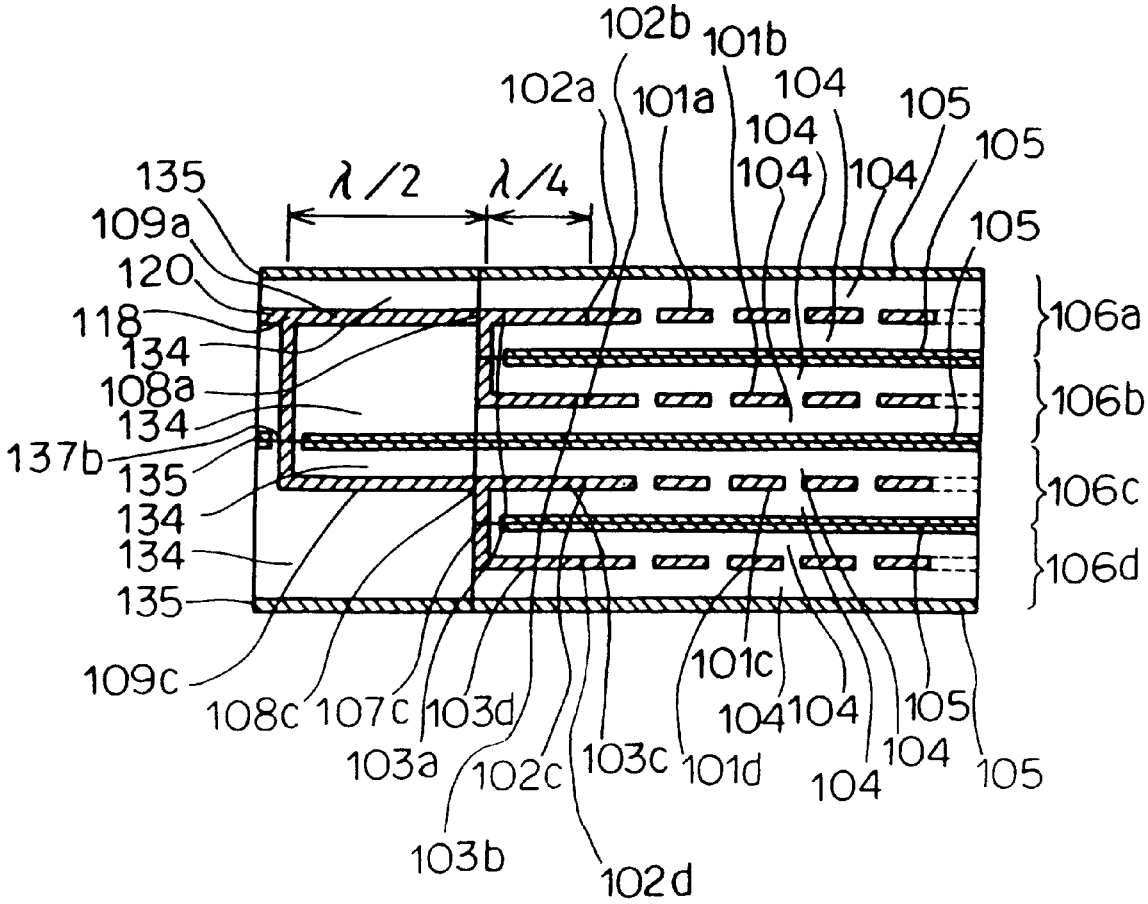
FIG. 5 is a side sectional view typically showing another example of the structure of the superconductive filter element.

As a variant of the above example, FIG. 5 shows another example of the superconductive filter element. Referring to the superconductive filter element, the filter block (up to the thin film coupling line) is separated from the output coupling line portion. The dielectric constant and thickness (distance between the ground electrodes) of the dielectric which surrounds the output coupling line is caused to differ from those of the filter block so that the width of the output coupling line is increased with the characteristic impedance equal to the input line and the like.

The output coupling line receives a signal having a power which is equal to the total of the signal power of the thin film coupling lines that are connected to one another on the coupling portions. Accordingly, if the width of the output coupling line is the same as that of the thin film connecting line, the current density of the signal sent on the output coupling line is several times as much as that of the thin film coupling line. If the coupling line is formed of a superconductive material, the critical current density of the line determines the maximum signal power which can be used. Accordingly, the width of the output coupling line is increased and the current density of the signal sent on the line is decreased so that the power used for the superconductive filter apparatus can be increased in the same manner as in the present example.

As is seen from FIG. 5, two thin film coupling lines 103*a* and 103*b* (or 103*c* and 103*d*) merge with an output coupling line 109*a* (or 109*c*) at the first coupling portion 108*a* (or 108*c*). Consequently, the thickness of a dielectric provided around the output coupling line 109*a* (or 109*c*), that is, the distance between the vertical ground electrodes 135 can be increased as compared with a dielectric provided around the thin film coupling line. Actually, the spacing between the vertical ground electrodes 135 of the output coupling line is made equal to the spacing between the vertical ground electrodes for two thin film coupling lines which merge (that is, the thickness of the two filter connecting line blocks) so that the matching of the dimensions of the output coupling lines 109*a* and 109*c* can be obtained. This can be realized by causing the substrate thickness of the dielectric 134 used in the output coupling line portion to differ from that of the dielectric 104 used for the filter block portion. A connection of the end face of the filter block thin film coupling line (first coupling portion) to the output coupling line can be obtained by press contact, wire bonding, metallic foils, silver pastes, conductive resins or the like.

If an oxide high temperature superconductive thin film such as lanthanum aluminates or MgO can be formed by a dielectric material, a superconductive electrode can be formed so that a loss can be reduced with high power. It is possible to combine the normal conductive metal electrode such as quartz glass (dielectric constant: $\in$=3.5 to 4.0), sapphire (dielectric constant: $\in$=8.6 to 10.6), alumina ceramics (dielectric constant: $\in$=8.0 to 11.0), steatite ceramics (dielectric constant: $\in$=6.0 to 7.0), polyethylene fluoride resins (dielectric constant: $\in$=2.0) and the like which are not very suitable for forming the oxide superconductive thin film.

According to the above example, it is preferred that the input line, ground electrode, thin film coupling line, output coupling line, output line, via hole and the like are formed of a superconductive material. They can be formed by a normal conductive metal material such as Au, Ag, Cu, Al, Pt or the like if the loss is not very serious. It is possible to use, as a superconductive thin film electrode material, a bismuth or yttrium system high temperature oxide superconductive thin film material as well as thallium-2212 phase high temperature oxide superconductive thin film material. In this case, the operation can be performed at a liquefied nitrogen temperature. In addition, a low temperature superconductive material such as Nb, Nb—Ti, $Nb_3Sn$ or the like can be used at a liquefied helium temperature (4.2 K). In this case, more substrate materials can be used as compared with the high temperature oxide superconductive thin film material.

Figure 6A:
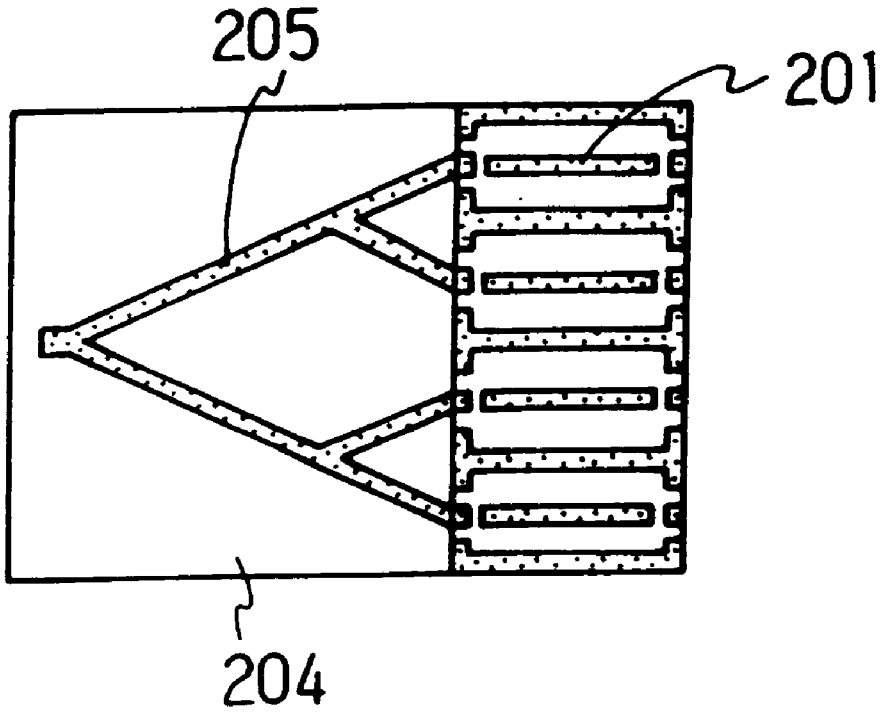
FIG. 6(A) is a plane view and FIG. 6(B) is a sectional view, which schematically show the structure of the superconductive filter element according to a third example of the present invention.
Figure 6B:
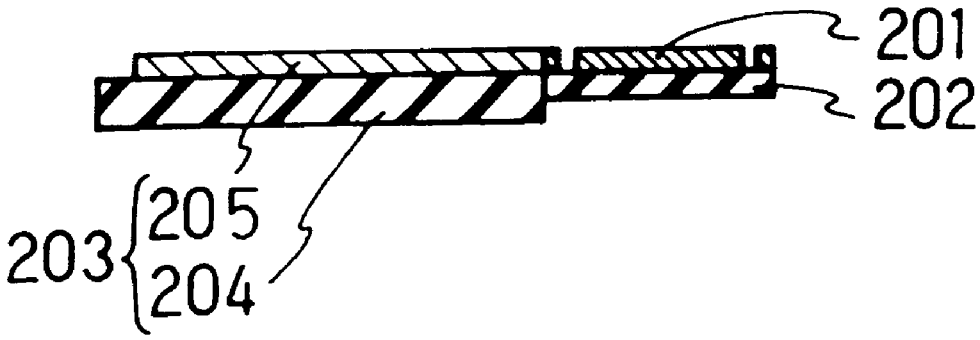

FIGS. 6(A) and 6(B) show the filter element of a low-temperature operating filter apparatus according to a third example of the present invention. FIG. 6(A) is a plane view, and FIG. 6(B) is a sectional view. A superconductive filter 201 is a microstrip line type formed by a Tl system superconductor, and has characteristics of 3 dB band width 150 KHz at 2 GHz, and is formed on a MgO base substance. Four superconductive filters 201 are connected to a junction box 203 of a thin film type at intervals of 5 mm through the filter coupling portion. A Tl system oxide superconductor (critical temperature 110 K, critical current density $1.0\times10^4$ A/cm$^2$) 205 is formed as a thin film conductor on a MgO base substance 204. The filter element is housed in the shield case, ground into a heat insulating container, and cooled to about 80 K by a freezer. Cr is deposited with a thickness of 200 angstrom (20 nm) on a face opposite to the element formation face of the base substances 202 and 204. Au is deposited on Cr with a thickness of 10 $\mu$m. The base substances 202 and 204 closely come in contact with a base metal to have the same potential, and are short-circuited with the ground electrode. The transmission lines of the superconductive filter and the junction box are wire-bonded to each other by Au or Al lines. The base substance 204 has a thickness of 1.00 mm which is twice as much as the thickness of the base substance 202. The transmission line has a characteristic impedance of 50Ω. If the characteristic impedances of the transmission lines are set to the same value, the thickness of the base substance is almost proportional to the width of the transmission line. Accordingly, the width of the transmission line of the junction box 203 is about 0.95 mm which is about twice as much as the width of the transmission line of the superconductive filter, i.e., 0.48 mm. As a result, the critical current is doubled so that a superconductive filter element which can use high power microwaves can be formed.

Microwaves having a power of 1 W are incident at a frequency 2 GHz band. As a result, the oxide superconductor as a thin film conductor does not lose superconductive characteristics on the junction box transmission line so that transmission having a lower loss can be ensured.

According to the above example, the thickness of the base substance 202 is different from that of the base substance 204. Other methods can be used for increasing the size of the transmission line (the sectional area of the transmission conductor). For example, a method for setting the dielectric constant of the base substance 204 smaller than that of the base substance 202 can be used. More specifically, MgO having a dielectric constant of 10 is used as the base substance 204, $YAlO_3$ having a dielectric constant of 16, $LaAlO_3$ having a dielectric constant of 24, $LaGaO_3$ or $NdGaO_3$ having a dielectric constant of 25 can be used as the base substance 202.

While the Tl system oxide superconductor is used as a thin film conductor in the present example, the kind of the oxide superconductor is not limited, and can be replaced with other superconductors such as a Bi or Y system. In particular, a Bi2223-phase is more advantageous because it is hardly toxic and exceeds a critical temperature of 100 K so that the freezer does not need high performance. In addition, a metal such as Au or Pt may be used as a thin film conductor. If a superconductor and a metal layered product are used for lines, transmission can be ensured by metals and an element is not broken even if the freezer gets out of order and the superconductor loses the superconductive characteristics. Consequently, the superconductor and the metal layered produce are effective in enhancing the stability of the superconductive filter apparatus.

While the superconductive filter of a microstrip line type has been used in the above example, a superconductive filter of another type such as an elliptical type may be used. In particular, resonance of the microwaves having a power which exceeds 10 W is ascertained in the superconductive filter of the elliptical type. Accordingly, if the superconductive filter of the elliptical type is used, it is possible to provide a superconductive filter apparatus which can handle the microwaves having a high power.

While the connection of the superconductor filter to the transmission line conductor of the junction box is performed by wire bonding in the above example, film bonding or welding can be utilized.

Figure 7:
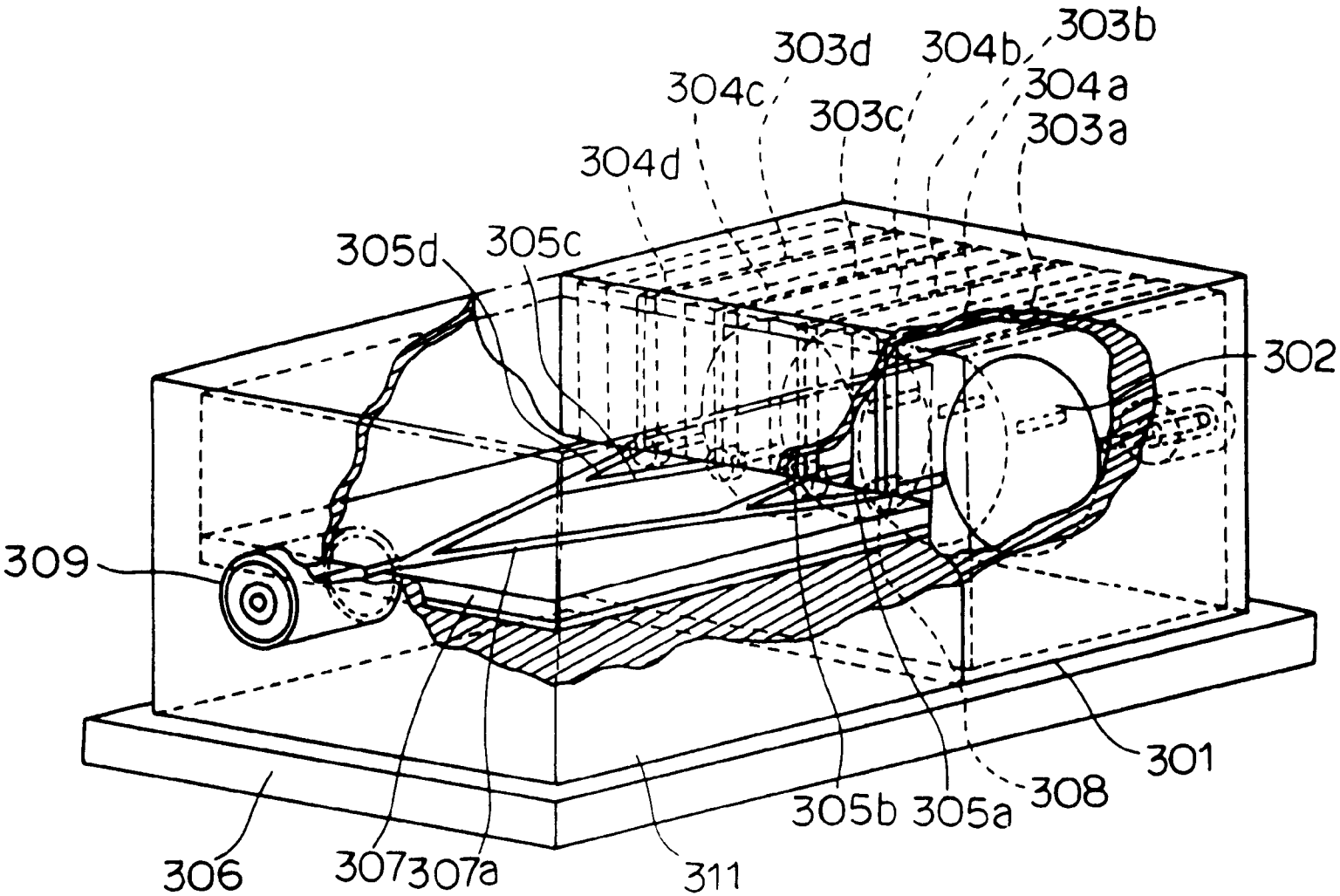
FIG. 7 is a perspective view showing a shield case block of a low temperature operating filter apparatus according to a fourth example of the present invention, which is partially cut out.

FIG. 7 shows the shield case block of a low temperature operating filter apparatus according to a fourth example of the present invention. According to the present example, two shield cases 301 and 311 are provided to form a shield case block. The shield cases 301 and 311 are in contact with each other and fixed onto a cooling table 306. The shield cases 301 and 311 and the cooling table 306 are made of a material such as Cu having a good thermal conductivity at a low temperature.

Four plane circuit filters 303*a*, 303*b*, 303*c*, 303*d* and their cooling plates 304*a*, 304*b*, 304*c*, 304*d* are alternately housed in the first shield case 301. The plane circuit filters 303*a*, 303*b*, 303*c*, 303*d* are in contact with the cooling plates 304*a*, 304*b*, 304*c*, 304*d*. The sets of the plane circuit filter and cooling plate are provided in parallel with each other. A filter electrode 302 made of a superconductive material is provided on each of the plane circuit filters 303*a*, 303*b*, 303*c*, 303*d* and designed to have passing frequency characteristics which are different little by little corresponding to the frequency band of each channel. The plane circuit filters 303*a*, 303*b*, 303*c*, 303*d* are shielded from each other and from the outside by the cooling plates 304*a*, 304*b*, 304*c*, 304*d* and the shield case 301.

A plane type junction unit (which corresponds to a junction box) 307 is housed in a second shield case 311. The junction unit 307 is comprised of a branch line 307*a* having lengths of $\lambda/4$ and $\lambda/2$ ($\lambda$ is a central wavelength) formed by a strip line on the substrate. Signal output lines 305*a*, 305*b*, 305*c*, 305*d* of the plane circuit filters 303*a* to 303*d* are connected to the input end of the branch line 307*a* through a connecting end member 308.

The dimension of the resonant element of the plane circuit type filter cannot be set smaller than a half wavelength (electric length) in the principle of operation. Consequently, it is hard to connect the plane circuit type filter to a branch line having a length of $\lambda/4$ on the same plane. The plane circuit filters are arranged in parallel in such a manner that the signal output line ends are arranged on the level with each other. The plane type junction unit 307 is connected to the plane circuit filter. Consequently, the above problems are solved so that the size of the shield case block can be reduced.

The output end of the branch line 307*a* is connected to an output connector 309 attached to a shield case 311. The input end of each plane type filter is connected to a filter input connector such as an SMA which is attached to the shield case 301. The insides of the shield cases 301 and 311 are in the vacuum state or sealed with gas such as helium filled therein.

The superconductive filter apparatus having the above structure is operated while being enclosed and cooled in a vacuum heat insulating container. A signal is input and output by four signal input connectors which penetrate the wall of the vacuum heat insulating container and are fixed thereto, and an antenna output connector. The signal input connector of each channel and a filter input connector, and the output connector 309 and an antenna output connector are connected to each other by coaxial lines such as semi-rigid cables.

Figure 8:
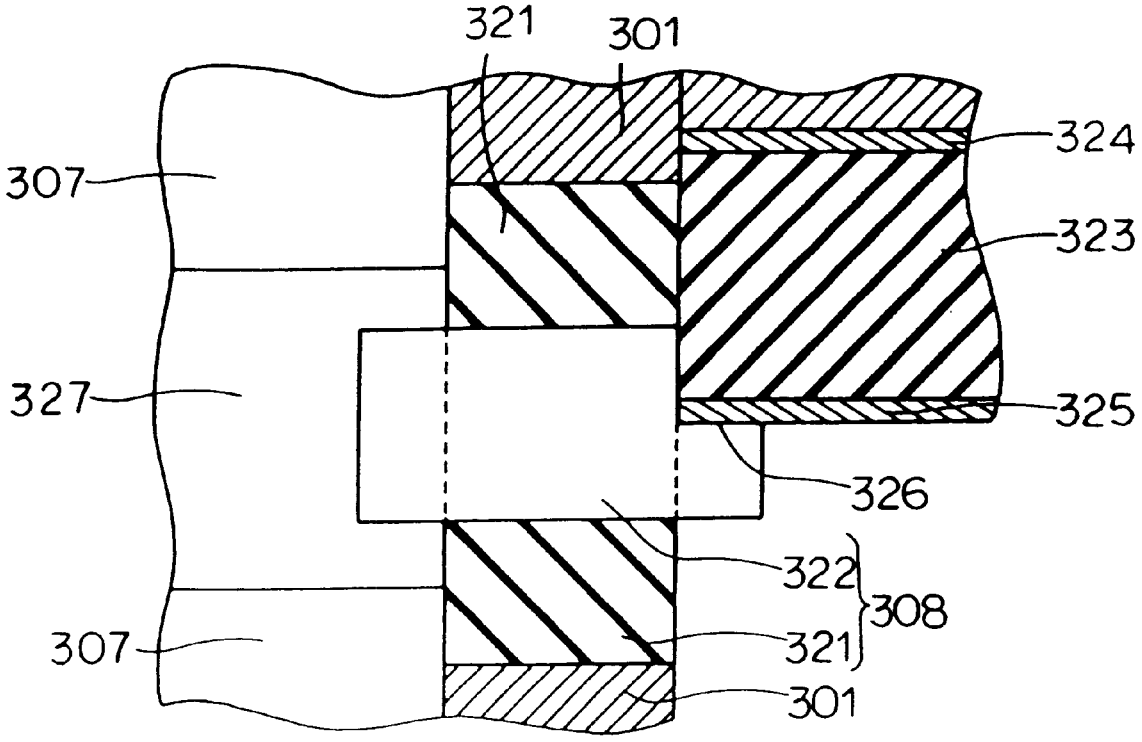
FIG. 8 is a plane view typically showing the connecting portion of a junction unit to the filter of the shield case block in FIG. 7.
Figure 9:
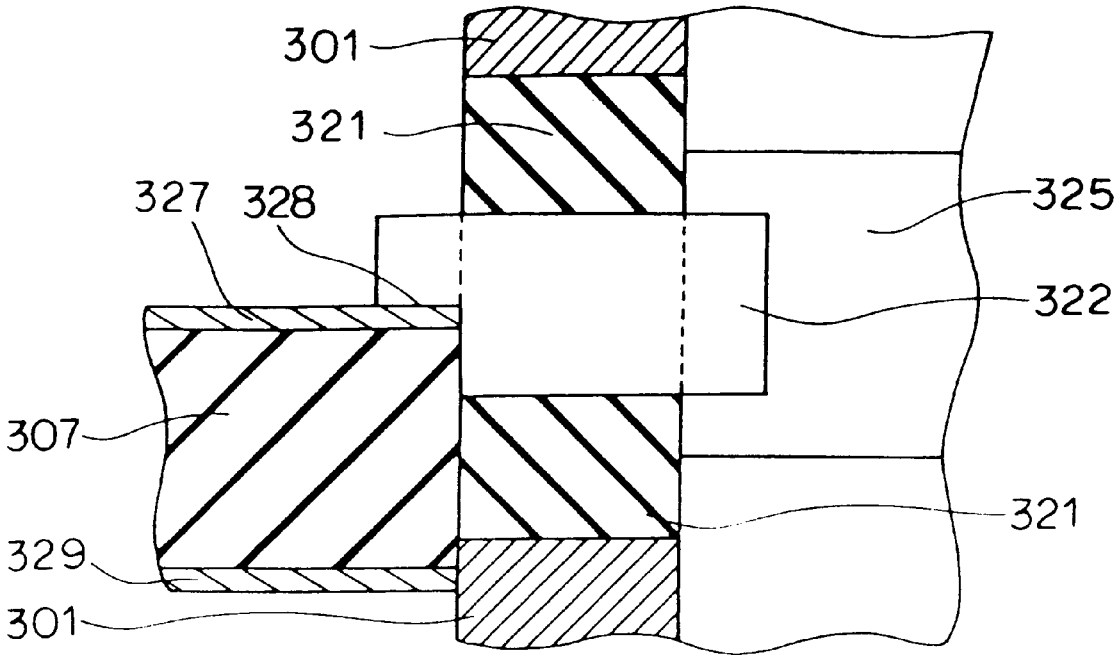
FIG. 9 is a side view typically showing the connecting portion in FIG. 8.

The structure of the connecting portion of the filter and the junction unit will be described below. Four through holes are formed on the side of the shield case 311 side of the shield case 301 at regular intervals. Connecting terminals 308 are fitted in the through holes by pressure. The four plane circuit filters 303*a* to 303*d* are connected to the junction unit 307 through the four connecting terminals 308. FIG. 8 is a typical view showing one of the four connecting portions seen from the top, and FIG. 9 is a typical view showing the same portion seen from the side. In FIG. 8 the reference number 323 denotes the plane circuit filters 303*a* and 303*d* shown in FIG. 7.

Figure 10:
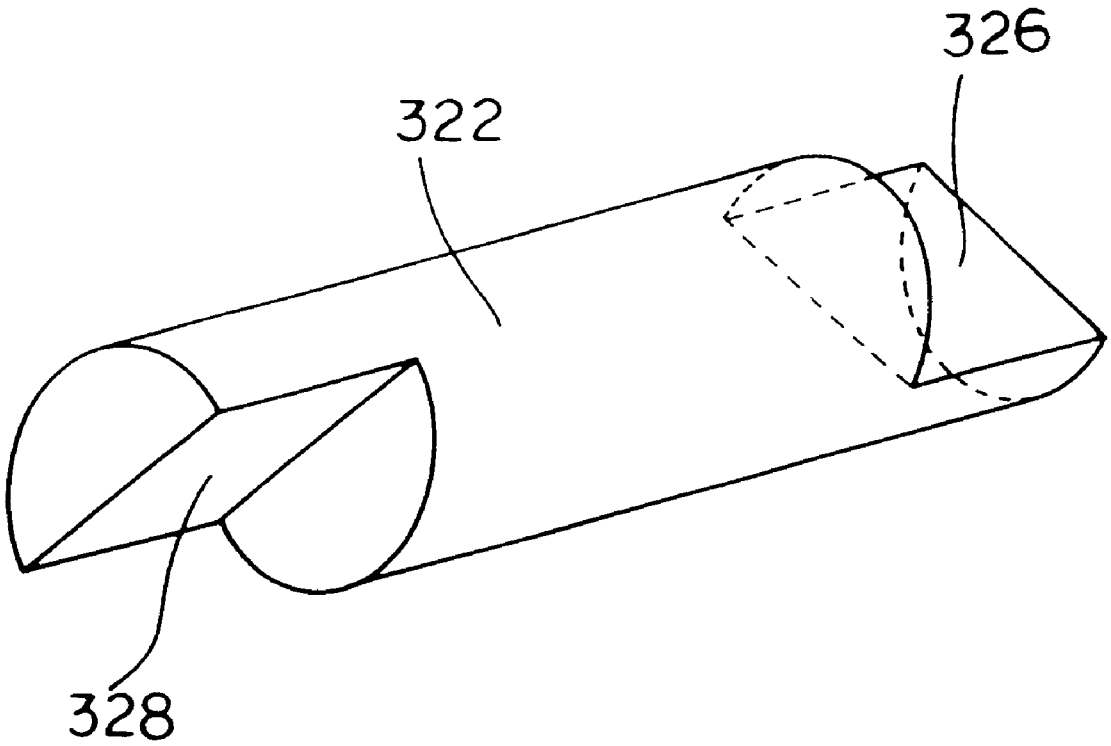
FIG. 10 is a perspective view showing a connecting conductor forming a connecting terminal.

As is seen from FIGS. 8 and 9, the connecting terminal 308 comprises an insulator 321 which is fitted in the through hole of the shield case 301 by pressure and a connecting conductor 322 which is fitted in the through hole on the central portion by pressure. The dimension of the connecting terminal 308 is designed based on a signal current capacity in such a manner that the characteristic impedance is equal to the impedance of the line. As shown in FIG. 10, the connecting conductor 322 has such a shape that both ends of the cylindrical conductive member are cut into semicircles in section and first and second contact faces 326 and 328 which are parallel with an axis are formed. The first contact face 326 is orthogonal to the second contact face 328. As shown in FIGS. 8 and 9, by setting such a angle, the first contact face 326 of the connecting conductor 322 comes in contact with the signal output line 325 of the plane circuit filter 323 and the second contact face 328 comes in contact with the input line 327 of the junction unit 307 (branch line 307*a*) of the junction unit 307 as shown in FIGS. 8 and 9. Consequently, the connecting loss can be reduced in the connecting portion.

As described above, the contact electrode 324 on the face opposite to the plane circuit filter 323 comes in contact with the cooling plate and are connected to the shield case 301. Similarly, a contact electrode 329 on the face opposite to the junction unit 307 is also connected to the shield case 311. Thus, the contact faces 326 and 328 of the connecting conductor 322 come in contact with the connecting lines so that the filter and the junction unit are connected to each other. Consequently, a heavy current can flow and a reflection loss can be reduced.

If a conductive material such as a metal, a superconductor or a conductive resin is filled in the contact portions of the contact faces 326 and 328 with the lines, a contact resistance is decreased so that heat generation is reduced. As a result, the critical current density of the superconductive electrode is hardly degraded. If the connecting portions are fixed by soldering or conductive resins, the mechanical and electrical stabilities can be enhanced.

While the filter electrode is made of the superconductive thin film material in the above example, other conductive materials may be made of a normal conductive metal such as Cu, Au or Ag as well as a superconductive material.

A manufacturing method according to the above example will be described below. In this example, the oxide high temperature superconductive material is used for the superconductive thin film material. Lanthanum aluminates ($LaAlO_3$, lattice constant: a axis 5.365 angstrom, c axis 13.11 angstrom, a dielectric constant: about 24) are used for the material of the dielectric substrate. A thallium 2212-phase (critical temperature ~110 K) high temperature oxide superconductive thin film material is formed as a superconductive thin film electrode material on both faces of the dielectric substrate, and is processed by the known technology so that a filter electrode or branch line is formed on one of the faces. Thus, the plane circuit filter and the junction unit are manufactured. Another face is used as a contact electrode as it is.

The four plane circuit filters thus manufactured are mounted on the shield case 301 to which the cooling plate and the connecting terminal are attached, and are fixed with respective contact electrodes in contact with the cooling plate. In this case, the first contact face 326 of the connecting conductor 322 of the connecting terminal 308 come in contact with the signal output lines 325 of the respective plane circuit filters 323 as shown in FIG. 8.

Then, the junction unit 307 is incorporated in the shield case 311. The shield case 311 is fixed to the shield case 301 in such a manner that the input line 327 of the junction unit 307 comes in contact with the second contact face 328 of the connecting conductor 322. Consequently, the shield case block is manufactured. If a very small gap is formed between the input line 327 and the second contact portion 328, the signal is fully transmitted by electrostatic coupling. However, a slight reflection loss occurs. In this case, a metallic foil (not shown) is inserted in the gap or between the contact electrode 329 of the junction unit 307 and the contact face of the shield case 311 so that the reflection loss and the insertion loss characteristics can be improved. In addition, it is more preferable that a mechanism which can adjust the relative distance (in the direction of a height) between the contact face of the ground electrode 329 of the shield case 311 and the second contact face 328 of the connecting conductor 322 is provided.

The dimension of the shield case block comprising the 4-channel superconductive filter manufactured in the above manner is about 110 mm width (W)×50 mm depth (D)×40 mm height (H) for 1.5 GHz. The shield case block is placed on the cooling plate in the heat insulating container having input-output connectors so that a low temperature operating filter apparatus is fabricated. The low temperature operating apparatus is attached to a freezer and operated at about 70 K. Consequently, higher performance than in the prior art can be obtained. As compared with the dimension of the whole filter system including the freezer, the volume is about ⅓ as much as that of a dielectric resonator filter apparatus having the same functions according to the prior art. Thus, the size can be reduced considerably. Furthermore, the insertion loss is less than several W in order to obtain a signal output of about 10 W per channel. Consequently, the power consumption is reduced by about 10 times as compared with the prior art. It is possible to considerably reduce the power consumption even if the power loss for an amplifier or the like is caused for the whole transmitting portion of the mobile communication base station system.

While the thallium-2212 phase high temperature oxide superconductive thin film electrode material is used as a superconductive thin film electrode material and the lanthanum aluminates are used as a dielectric substrate material in the above description, the present invention is not restricted thereto. The bismuth system, yttrium system and thallium system high temperature oxide superconductive materials can be used. In this case, the operation can be performed at a liquefied nitrogen temperature. Furthermore, a low temperature superconductive material such as Nb, Nb—Ti or $Nb_3Sn$ can be used at about a liquefied helium temperature (4.2 K). In this case, the choices of the substrate material are greater than those of the high temperature oxide superconductive thin film material.

Figure 11:
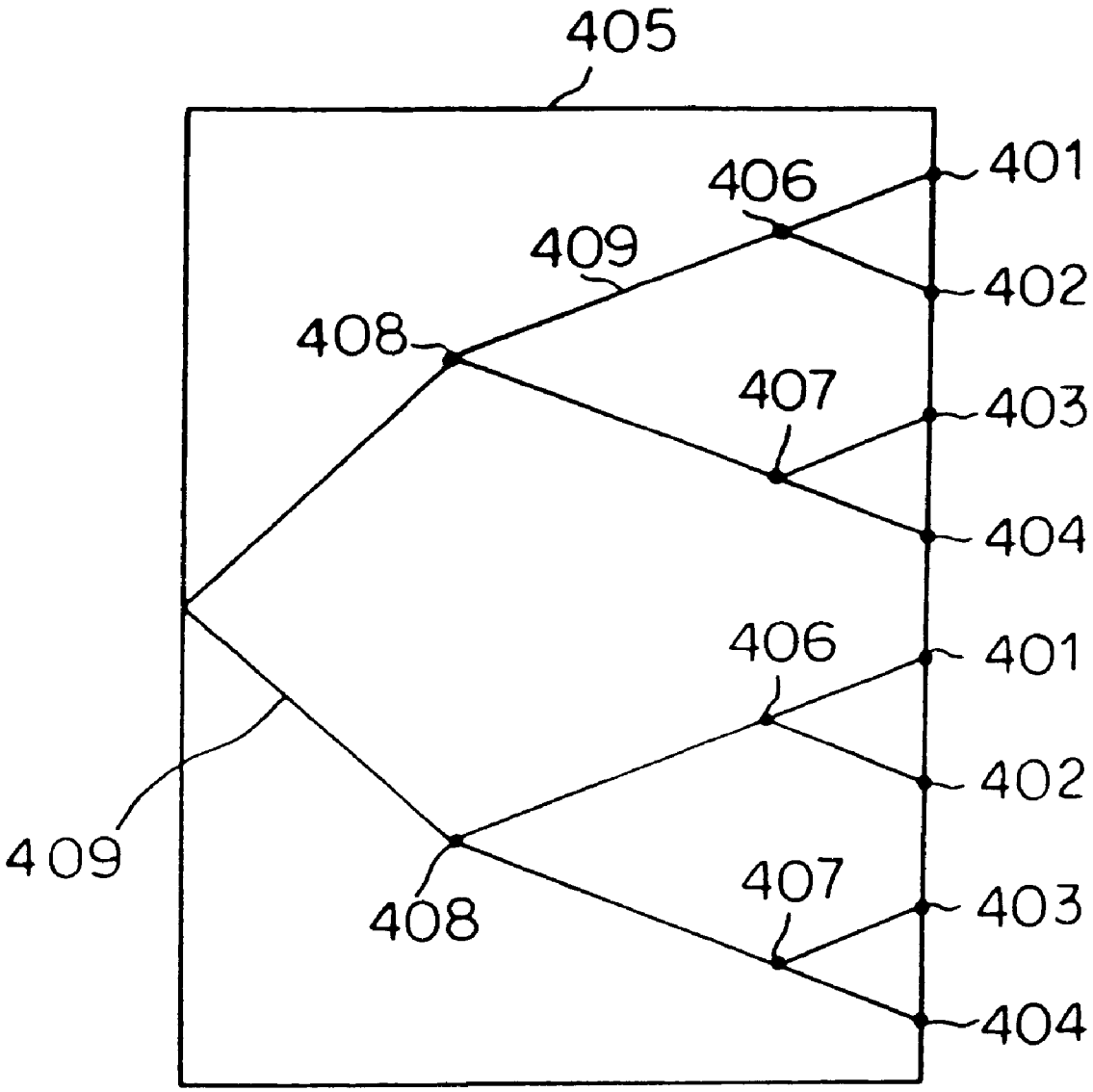
FIG. 11 is a plane view typically showing the junction box of a low temperature operating filter apparatus according to a fifth example of the present invention.

FIG. 11 is a typical plane view showing a junction box of a low temperature operating filter apparatus according to a fifth example of the present invention. Output connecting portions 401, 402, 403 and 404 of a small-sized microwave filter (2 GHz) such as a superconductive filter are sequentially provided straight at regular intervals of 5 mm on one of the ends of a MgO base substance having a thickness of 0.5 mm. A first merging point 406 is provided on the MgO base substance 405 at a distance of $\lambda/4$ from the filter output connecting portions 401 and 402. A first isosceles triangle structure is formed by the filter output connecting portions 401 and 402 and the first merging point 406. A second merging point 407 is provided on the MgO base substance 405 at a distance of $\lambda/4$ from the filter output connecting portions 403 and 404. A second isosceles triangle structure is formed by the filter output connecting portions 403 and 404 and the second merging point 407. A third merging point 408 is provided on the MgO base substance 405 at a distance of $\lambda/2$ from the first and second merging points 406 and 407. A third isosceles triangle structure is formed by the first and second merging points 406 and 407 and the third merging point 408. $\lambda$ is a wavelength at the average resonant frequency of the filter. The dielectric constant of MgO is 10. Hence, $\lambda$ is about 47 mm if the microwave has a frequency of 2 GHz. The filter output connecting portions 401, 402, 403 and 404 are connected to the first, second and third merging points 406, 407 and 408 through branch lines 409 having the same width. If the characteristic impedance of the branch line 409 is 50Ω, the width of the branch line 409 is about 0.48 mm.

Two sets of structures formed by the three isosceles triangles are provided on the MgO base substance 405. The third merging point 408 is connected by the branch line 409 having a length of $\lambda/2$. All the branch lines 409 are formed by a thin film Tl system oxide superconductor (critical temperature: 10 K, critical current density: $1.0\times10^4$ A/cm$^2$) having a thickness of 2 $\mu$m. The junction box and the filter are incorporated in a shield case and provided in a heat insulating container. A low temperature operating filter apparatus thus formed is cooled by a freezer to about 80 K.

It is proved that sharing transmission having a low loss can be performed by means of a small-sized freezer when microwaves having a power of 1 W and a frequency of 2 GHz band are incident.

According to the structure of the junction box of the present example, the filter output connecting portions 401, 402, 403 and 404 are provided straight at regular intervals. Consequently, the filter output connecting point 401, the first merging point 406 and the third merging point 408 are on the same straight line. Similarly, the filter output connecting portion 404, the second merging point 407 and the third merging point 408 are on the same straight line. Accordingly, a radiation loss can be prevented from occurring due to the bend of the branch lines 409 on the first and second merging points 406 and 407.

Since the junction box according to the present example has a structure which is based on the three isosceles triangles, it can be formed on the same plane. By using such a structure, it is possible to obtain the junction box by the form of a thin film provided on the same base substance. Consequently, it is easy to obtain a connection to a thin film type microwave filter. In addition, a transmission line can be reduced more than the prior art so that the junction box having a low loss can be implemented.

While the filter output connecting portions 401, 402, 403 and 404 are arranged at regular intervals on one of ends of the MgO base substance 405 and the branch line has a length of $\lambda/4$ in a first stage and a length of $\lambda/2$ in a second stage in the present example, the present invention is not restricted thereto. For example, even if the branch line has a length of $(2n+1)\lambda/4$ in the first stage and a length of $(m+1)\lambda/2$ in the second stage and the filter output connecting portions are not arranged at regular intervals, the three isosceles triangle structures are used as described above so that the junction box can be implemented by the form of the thin film provided on the same base substance and the junction box having similar characteristics can be obtained, wherein n and m are 0 or natural numbers. A structure in which n and m are not 0 is effective in the case where microwaves having a high frequency of 2 GHz or more are used or a base substance having a great dielectric constant is used so that the length of a transmission line is too small to fabricate the junction box.

While two structures each having four filter output connecting portions are arranged in the present example, the present invention is not restricted thereto. For example, three filter output connecting portions may be used. In the case where three structures are arranged, the third merging point 408 may be connected by a transmission line having a length of $(1+1)\lambda/2$, wherein 1 is a 0 or a natural number.

Figure 12:
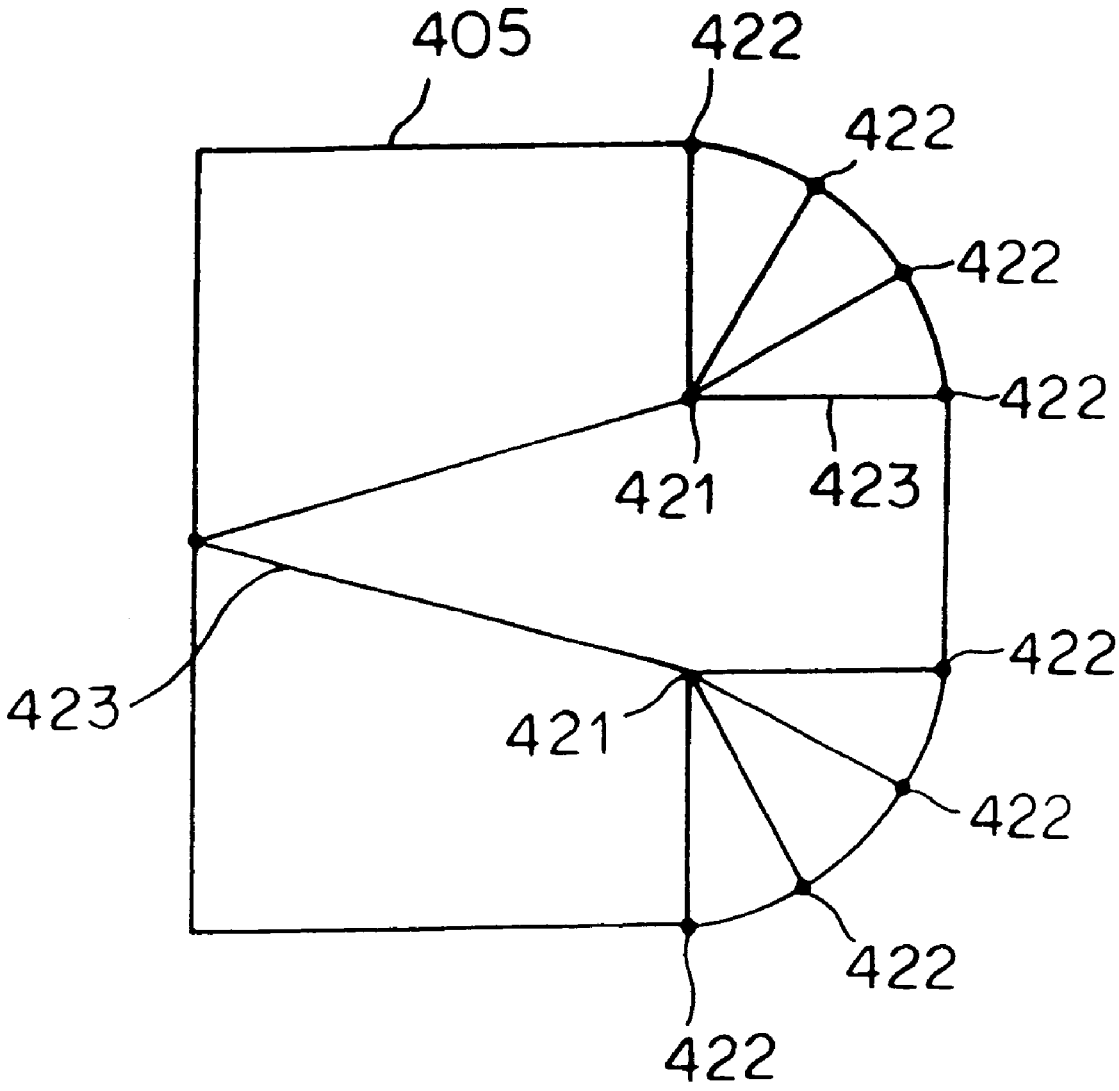
FIG. 12 is a plane view typically showing a junction box according to a sixth example of the present invention.
Figure 13:
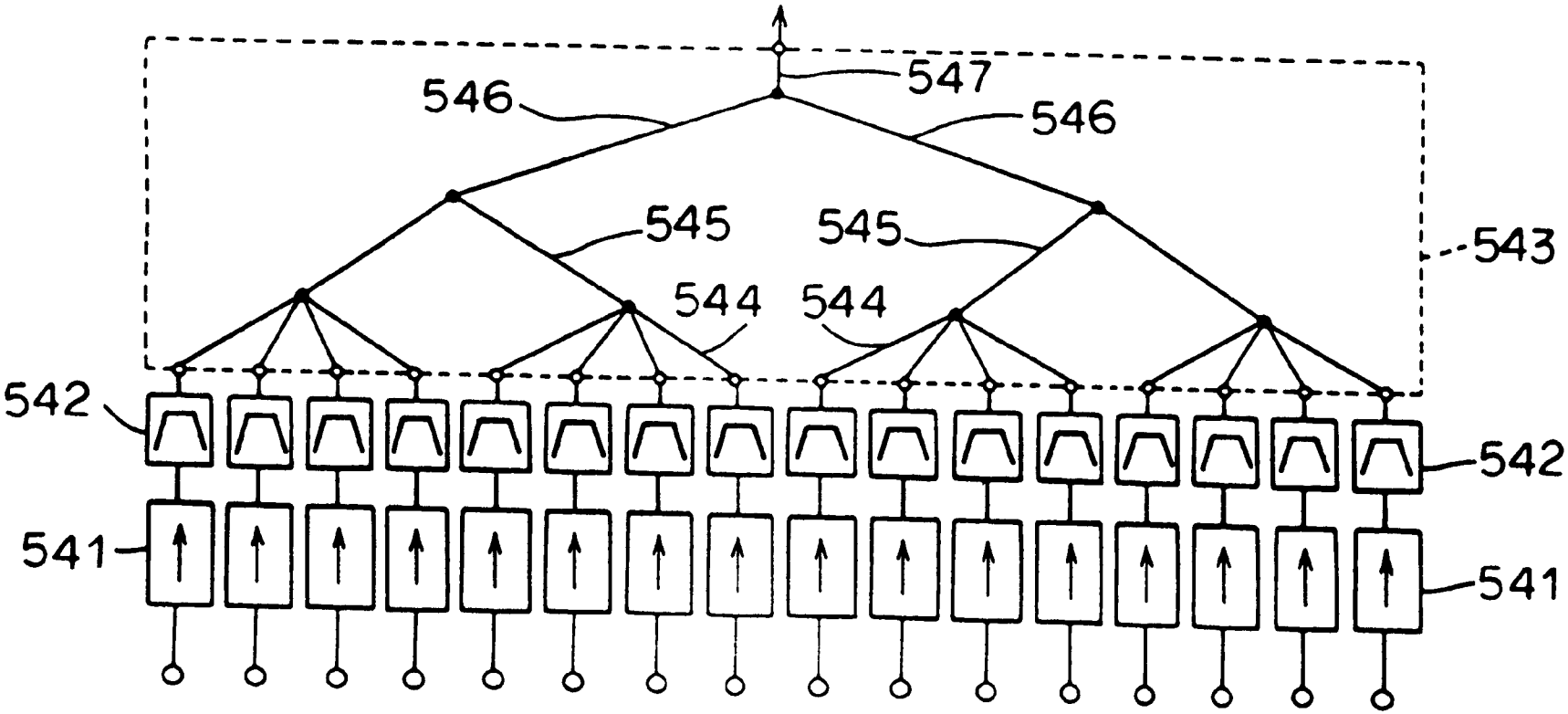
FIG. 13 PRIOR ART
FIG. 13 is a view showing an example of a power filter apparatus according to the prior art.

FIG. 12 is a typical plane view showing a junction box of a low temperature operating filter apparatus according to a sixth example of the present invention. The junction box according to the present example differs from the above example in that filter output connecting portions 422 are arranged like an arc having a radius of $\lambda/4$ around merging points 421.

Four filter output connecting portions 422 are arranged like an arc around the merging points 421 at regular intervals of 5 mm on the MgO base substance 405. Each filter output connecting portion 422 is connected to the merging point 421 by a branch line 423 having a width of about 0.48 mm so that a fan-shaped structure is formed.

Two fan-shaped structures are formed on the MgO base substance 405 and connected to each other through the branch line having the same width as that of the branch line 423 having a length of $\lambda/2$. Other conditions such as the material of the branch line 423, a microwave frequency and the like are the same as those of the above examples.

While the base substance 405 of the present example has an arc-shaped contour for connecting the filter output connecting portions 422 as shown in FIG. 12, the external form is not restricted thereto. In consideration of functions, it is sufficient that the signal connection can be realized so as not to cause extreme impedance change on the filter output connecting portions 422. For example, the base substance 405 may be cut out on a plane which is almost orthogonal to the branch line 423 on the filter output connecting portion 422. According to such a shape, the ground electrode end face of the connecting end of the filter output line which is connected to the branch line 423 on the filter output connecting portion 422 can take the shape of a plane. Consequently, manufacture can be performed easily.

The filter output connecting portion 422 is connected to the filter output line by a gold foil or a copper foil, or wire bonding such as a gold line or an Al—Si line. The connection between the ground electrodes of the junction box to the filter should be performed by bonding the gold foil or the copper foil to them with a silver paste or the like. A shield case in which the junction box and the filter are embedded may be connected.

In the same manner as in the above example, a low temperature operating filter apparatus is manufactured by using the junction box according to the present example and is cooled to about 80 K by means of a small-sized freezer. Then, microwaves having a power of 2 W and a frequency of 2 GHz band are incident. As a result, it is proved that sharing transmission having a low loss can be performed.

Referring to the structure of the junction box formed based on the fan-shape according to the present example, the junction box can be formed on the same plane so that it can be implemented by the shape of a thin film formed on the same base substance similarly to the first example. Since the node to the filter has the fan-shape, the number of the filter output connecting portions 422 can be increased easily. Consequently, the merging from the filter output connecting portions 422 to a merging point 421 can be performed. Thus, it is possible to obtain a compact junction box having a very small loss.

The junction box of the present example has the fan-shaped structure so that a sufficient space can be kept among the filter output connecting portions. The filter can easily be formed on the same base substance as the junction box. In this case, it is preferred that a small-sized filter formed by a thin film such as a superconductive filter is utilized.

While the junction box according to the present example has a branch line length of $\lambda/4$ and $\lambda/2$ in the present example, it is not restricted thereto. For example, a branch line having a length of $(2n+1)\lambda/4$ or $(m+1)\lambda/2$ may be used in the same manner as the above examples, wherein n and m are natural numbers.

The junction box of the present example has a structure in which two fan-shaped structures are connected. The number of the fan-shaped structures may be three or more.

While the junction box uses the Ti system superconductor for the branch line in the above and present examples, metals such as Au, Pt, Cu, Ag and the like can be used. In the case where the oxide superconductor is used as the branch line, superconductors other than the Tl system superconductor, for example, the Bi and Y system superconductors can be used. In particular, $Bi_2Sr_2Ca_2Cr_3O_{10+x}$ the parameter x is arranged such as $x<1$ which is the usual range described for a known type of superconductor, is hardly toxic and has a critical temperature which is more than 100 K so that it is not necessary to increase the size of the freezer. If a layered product of a superconductor and a metal is used as the branch line, transmission can be ensured by the metal even if the superconductor loses superconductivity due to freezer failure or the like. Consequently, the transmission functions are not completely lost so that the stability of the junction box can be enhanced.

The material used for the base substance of the junction box is not limited to MgO. For example, $LaAlO_3$, $SrTiO_3$, $LaGaO_3$, $NdGaO_3$ and the like can be used. If $LaAlO_3$ is used, the crystalline properties of the branch line (oxide superconductor) can be enhanced because the mismatching of the lattice constant with the branch line made of the oxide superconductor is small. As a result, the critical temperature and critical current density can be improved so that the power of the freezer can be reduced. In addition, microwaves having a great power can be used. Also in the case where $SrTiO_3$, $LaGaO_3$ and $NdGaO_3$ are used, the same effects can be obtained. In particular, if $SrTiO_3$ is used, the size of the junction box can be reduced still more because a dielectric constant is great, i.e., 310.

The invention may be embodied in other forms without departing from the spirit or essential characteristics thereof. The embodiments disclosed in this application are to be considered in all respects as illustrative and not restrictive, the scope of the invention is indicated by the appended claims rather than by the foregoing description, and all changes which come within the meaning and range of equivalency of the claims are intended to be embraced therein.

What is claimed is:

1. A low temperature operating transmitting filter apparatus having a filter element, comprising:

a plurality of filter coupling line blocks each of which is composed of a filter electrode of a superconductive thin film and a thin film coupling line, the respective thin film coupling line having a length of $(2m+1)\lambda/4$, wherein m is 0 or a natural number and $\lambda$ is a signal wavelength, the respective thin film coupling line being connected to an output end of the corresponding filter electrode; and at least one output coupling line having the same characteristic impedance as that of the respective thin film coupling line, which is connected to an end of the respective thin film coupling line on an opposite side of the corresponding filter electrode;

wherein a number of the at least one output coupling line is smaller than a number of the thin film coupling lines.

2. A low temperature operating transmitting filter apparatus according to claim 1 wherein:

the filter element has a structure in which a filter aggregate is composed of a plurality of plane filter electrodes, and a junction box is composed of branch lines including the thin film coupling lines and each of the respective output coupling lines provided on a substrate, the filter electrodes being connected to the branch lines of the junction box through a plurality of connecting terminals, respectively;

the junction box is arranged in such a manner that a plane including the junction box intersects a respective face of each of the plane filter electrodes; and each of the connecting terminals includes a connecting conductor which has a first contact face parallel with a corresponding face of the plane filter electrode on a first end and a second contact face parallel with a corresponding face of the junction box on a second end.

3. The low temperature operating transmitting filter apparatus according to claim 2, wherein a conductive material is provided between the first respective contact face and the corresponding filter electrode of each of the plane filter electrodes.

4. The low temperature operating transmitting filter apparatus according to claim 2, wherein a conductive material is provided between the second respective contact face and the corresponding branch line of the junction box.

5. The low temperature operating transmitting filter apparatus according to claim 2, wherein the first respective contact face is in contact with the corresponding filter electrode of each of the plane filter electrodes, and the second respective contact face is in contact with the corresponding branch line of the junction box.

6. The low temperature operating transmitting filter apparatus according to claim 2, wherein the first and second contact faces of each connecting terminal are orthogonal to each other in a longitudinal axis of the connecting terminal.

7. The low temperature operating transmitting filter apparatus according to claim 1, wherein the corresponding filter electrode and the respective thin film coupling line in each of the filter coupling line blocks are located on a common plane.

8. The low temperature operating transmitting filter apparatus according to claim 7, wherein the respective thin film coupling line is a lamination of an oxide superconductor film and a metal film.

9. A low temperature operating transmitting filter apparatus according to claim 8, wherein a part of the filter element between the output ends of the filter electrodes and an output portion of the respective output coupling line is composed of a junction box, the junction box including at least one structure comprising:

first, second, third, and fourth filter output connecting portions corresponding to four of the output ends of the filter electrodes, respectively;

a first merging point provided at a distance of $(2n+1)\lambda/4$ from both of the first and second filter output connecting portions, wherein $\lambda$ is a wavelength at an average resonant frequency of the filter element and n is 0 or natural numbers;

a second merging point provided at a distance of $(2n+1)\lambda/4$ from both the third and fourth filter output connecting portions and present on a plane including the first and second filter output connecting portions and the first merging point; and a third merging point provided at a distance of $(m+1)\lambda/2$ from both of the first and second merging points, wherein m is 0 or natural numbers, and present on the plane including the first and second filter output connecting portions and the first merging point; and straight branch lines having a form of a thin film attached to a base substance and the same characteristic impedance as that of the respective thin film coupling line, and connecting at least three of the first, second, third, and fourth filter output connecting portions to the first, second and third merging points.

10. The low temperature operating transmitting filter apparatus according to claim 7, wherein the respective thin coupling line is composed of a metal film.

11. The low temperature operating transmitting filter apparatus according to claim 7, wherein the respective thin film coupling line is composed of an oxide superconductor film.

12. A low temperature operating transmitting filter apparatus having a filter element, comprising:

a plurality of filter coupling line blocks being laminated to each other, each of which is composed of a filter electrode of a superconductive thin film and a thin film coupling line, the respective thin film coupling line having a length $(2m+1)\lambda/4$, wherein m is 0 or a natural number and $\lambda$ is a signal wavelength, the respective thin film coupling line being connected to an output end of the corresponding filter electrode;

first conductive connector which extends in a direction of lamination and connects an end of the respective thin film coupling line on an opposite side of the corresponding filter electrode to form a first coupling portion;

a plurality of first output coupling lines, each having a length of $n\lambda/2$, wherein n is a natural number and $\lambda$ is a signal wavelength, whose characteristic impedance is the same as that of the respective thin film coupling line, the respective first output coupling line is connected to the first coupling portion;

second conductive connector which extends in the direction of lamination and connects ends of the respective first output coupling lines on an opposite side of the first coupling portion to form a second coupling portion; and a respective second output coupling line having the same characteristic impedance as that of the respective first output coupling line, which is connected to the second coupling portion.

* * * * *